US009997012B2

(12) United States Patent
Wortmann et al.

(10) Patent No.: US 9,997,012 B2
(45) Date of Patent: Jun. 12, 2018

(54) GAMING MACHINE WITH SYMBOL RESTRICTION

(71) Applicant: Pridefield Limited, Douglas, Isle of Man (GB)

(72) Inventors: Jonathan B. Wortmann, Ballarat (AU); Terence Igesund, Kaw-Zulu Natal (ZA)

(73) Assignee: Pridefield Limited (GB)

( * ) Notice: Subject to any disclaimer, the term of this patent is extended or adjusted under 35 U.S.C. 154(b) by 0 days. days.

(21) Appl. No.: 15/485,984

(22) Filed: Apr. 12, 2017

(65) Prior Publication Data

US 2017/0316641 A1 Nov. 2, 2017

(30) Foreign Application Priority Data

Apr. 28, 2016 (GB) ..... 1607380.1

(51) Int. Cl.
*A63F 9/24* (2006.01)
*G07F 17/32* (2006.01)
*G07F 17/34* (2006.01)

(52) U.S. Cl.
CPC ..... *G07F 17/3213* (2013.01); *G07F 17/3227* (2013.01); *G07F 17/3262* (2013.01); *G07F 17/34* (2013.01)

(58) Field of Classification Search
CPC ... G07F 17/34; G07F 17/3258; G07F 17/3213
See application file for complete search history.

(56) References Cited

U.S. PATENT DOCUMENTS 5,704,835 A 1/1998 Dietz, II
6,379,248 B1 4/2002 Jorasch et al.
(Continued)

FOREIGN PATENT DOCUMENTS

AU 2003246319 10/2003
AU 2013251288 5/2014
(Continued)

OTHER PUBLICATIONS

Australian Government, IP Australia, Examination Report No. 2 dated Jul. 14, 2017, issued in connection with Australian Patent Application No. 2016202966, 6 pages.
(Continued)

*Primary Examiner* — Steve Rowland
(74) *Attorney, Agent, or Firm* — McDonnell Boehnen Hulbert & Berghoff LLP

(57) ABSTRACT

A gaming machine may award a number of spins of a plurality of reels in an instance of the bonus game. A symbol counter may be set to an initial value. Until the awarded number of bonus game spins have been performed, the gaming machine may repeatedly carry out iterations of bonus game operations including: (i) selecting a first symbol set or a second symbol set for display on the plurality of reels, where the first symbol set excludes a predetermined symbol, where the second symbol set includes a number of the predetermined symbol equivalent to the symbol counter, and where, when the second symbol set is selected, the symbol counter is incremented, and (ii) transmitting, to a client machine, a representation of the selected symbol set.

18 Claims, 21 Drawing Sheets

(56) References Cited

U.S. PATENT DOCUMENTS 6,439,993 B1 8/2002 O'Halloran
6,561,904 B2 * 5/2003 Locke ..... G07F 17/32 463/20
6,712,697 B2 3/2004 Acres
6,743,102 B1 6/2004 Fiechter et al.
6,855,054 B2 2/2005 White et al.
6,939,228 B2 9/2005 Shimizu
7,063,617 B2 6/2006 Brosnan et al.
7,090,580 B2 8/2006 Rodgers et al.
7,237,775 B2 7/2007 Thomas et al.
7,331,862 B2 2/2008 Rodgers et al.
7,331,866 B2 2/2008 Rodgers et al.
7,331,867 B2 2/2008 Baelocher et al.
7,341,518 B2 3/2008 Muskin
7,393,278 B2 7/2008 Gerson et al.
7,850,521 B2 12/2010 Rodgers et al.
7,857,695 B2 12/2010 Rodgers et al.
7,950,994 B2 5/2011 Berman et al.
8,430,743 B2 4/2013 Moshal
8,734,237 B2 5/2014 Moshal
9,224,270 B2 12/2015 Lee et al.
9,659,456 B2 5/2017 Van Linden
9,830,780 B2 11/2017 Cuddy et al.
2002/0039920 A1 * 4/2002 Bryant ..... G07F 17/3244 463/20
2002/0045474 A1 4/2002 Singer et al.
2002/0151359 A1 10/2002 Rowe
2003/0064810 A1 4/2003 Okada
2003/0155715 A1 8/2003 Walker et al.
2003/0162585 A1 * 8/2003 Bigelow, Jr. ..... G07F 17/32 463/20
2003/0162588 A1 8/2003 Brosnan et al.
2004/0032086 A1 2/2004 Barragan
2004/0097280 A1 5/2004 Gauselmann
2004/0254011 A1 12/2004 Muskin
2004/0259640 A1 12/2004 Gentles et al.
2005/0010715 A1 1/2005 Davies et al.
2005/0054420 A1 3/2005 Cregan et al.
2005/0153778 A1 7/2005 Nelson et al.
2005/0170883 A1 8/2005 Muskin
2005/0239545 A1 10/2005 Rowe
2006/0084494 A1 * 4/2006 Belger ..... G07F 17/3265 463/20
2006/0264254 A1 11/2006 Aoki
2006/0281525 A1 12/2006 Borissov
2007/0026933 A1 2/2007 Tanimura
2007/0054732 A1 3/2007 Baerlocher
2007/0060303 A1 3/2007 Govender et al.
2007/0060314 A1 3/2007 Baerlocher et al.
2007/0060317 A1 3/2007 Martin
2007/0167226 A1 7/2007 Kelly et al.
2007/0287529 A1 12/2007 Kojima
2008/0039171 A1 2/2008 Slomiany et al.
2008/0076574 A1 3/2008 Okada
2008/0113742 A1 * 5/2008 Amos ..... G07F 17/32 463/20
2008/0108411 A1 8/2008 Jensen et al.
2008/0287178 A1 11/2008 Berman et al.
2009/0054129 A1 2/2009 Yoshimura et al.
2009/0069071 A1 3/2009 Aoki et al.
2009/0104979 A1 4/2009 Ruymann
2009/0156303 A1 6/2009 Kiely et al.
2009/0305769 A1 12/2009 Plowman
2009/0305770 A1 12/2009 Bennett et al.
2010/0004050 A1 1/2010 Caputo et al.
2010/0022297 A1 1/2010 Saunders
2010/0056249 A1 * 3/2010 Yamauchi ..... G07F 17/3244 463/20
2010/0120525 A1 5/2010 Baerlocher et al.
2011/0028202 A1 2/2011 Naicker et al.
2011/0117987 A1 5/2011 Aoki et al.
2012/0015713 A1 1/2012 Cannon
2012/0122546 A1 5/2012 Lange
2012/0122547 A1 5/2012 Aoki et al.
2012/0244928 A1 * 9/2012 Visser ..... G07F 17/3225 463/21
2012/0258787 A1 * 10/2012 Bennett ..... G07F 17/3244 463/21
2012/0276980 A1 * 11/2012 Moroney ..... G07F 17/32 463/21
2012/0295688 A1 11/2012 Watkins et al.
2013/0023329 A1 1/2013 Saunders
2013/0143635 A1 6/2013 Arora et al.
2013/0157733 A1 6/2013 Thorne et al.
2013/0184047 A1 7/2013 Haykin et al.
2014/0179400 A1 * 6/2014 Lee ..... G07F 17/34 463/20
2015/0248811 A1 9/2015 Wortmann et al.
2015/0287276 A1 * 10/2015 Humphrey ..... G07F 17/3225 463/31
2016/0351005 A1 12/2016 Igesund
2016/0351006 A1 12/2016 Igesund

FOREIGN PATENT DOCUMENTS

CA 2827968 3/2014
CA 2868773 4/2015
EP 1351180 10/2003
EP 2615591 3/2013
EP 2713347 4/2014
EP 2866211 4/2015
EP 2894612 7/2015
EP 2916299 9/2015
GB 2139390 11/1984
GB 2393018 3/2004
WO 2002/41963 5/2002
WO 2006/027677 3/2006

OTHER PUBLICATIONS

European Patent Office, Extended European Search Report dated Jun. 6, 2017, issued in connection with Application No. EP 17153144.5, 9 pages.
Australian Government, IP Australia, Examination Report No. 1 dated Mar. 28, 2017, issued in connection with Australian Patent Application No. 2016202966, 2 pages.
Australian Government, IP Australia, Examination Report No. 1 dated Mar. 29, 2017, issued in aonnection with Australian Patent Application No. 2016202965, 3 pages.
Australian Government, IP Australia, Patent Examination Report No. 1, dated Dec. 20, 2012, issued in connection with Australian Patent Application No. 2011253848, 4 pages.
Canadian Intellectual Property Office, Examiner's Report dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Report dated Feb. 5, 2013, issued in connection with CA Application No. 27602112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in aonnection with EP Application No. 05789874.4, 6 pages.
Final Office Action dated Sep. 14, 2012, issued in connection with U.S. Appl. No. 12/511,391, filed Jul. 29, 2009, 14 pages.

(56) References Cited

OTHER PUBLICATIONS

Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 8 pages.
Non-Final Office Action dated Apr. 4, 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,124, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006, 4 pages.
Notice of Allowance dated Apr. 10, 2014, issued in connection with U.S. Appl. No. 13/856,124, filed Apr. 3, 2013, 7 pages.
Notice of Allowance dated Mar. 11, 2013, issued in connection with U.S. Appl. No. 12/974,690, filed Dec. 21, 2009, 14 pages.
Wortman, Jonathan, U.S. Appl. No. 15/392,946, filed Dec. 28, 2016, 44 pages.
Canadian Intellectual Property Office, Examiners Report dated Jan. 16, 2018, issued in connection with Canadian Patent Application No. 2,929,218, 8 pages.
Australian Government, IP Australia, Examination Report No. 3 dated Nov. 21, 2017, issued in connection with Australian Patent Application No. 2016202966, 4 pages.
Notice of Allowance dated Dec. 20, 2017, issued in connection with U.S. Appl. No. 15/141,010, filed Apr. 28, 2016, 8 pages.
Non-Final Office Action dated Jan. 29, 2018, issued in connection with U.S. Appl. No. 15/487,869, filed Apr. 14, 2017, 12 pages.
Australian Government, IP Australia, Examination Report No. 1 dated Oct. 14, 2017, issued in connection with Australian Patent Application No. 2017200271, 4 pages.
Canadian Canadian Intellectual Property Office, Examiner's Report dated Dec. 19, 2017, issued in connection with Canadian Patent Application No. 2,954,790, 3 pages.
United Kingdom Intellectual Property Office, Search Report dated Jun. 28, 2017, issued in connection with Great Britain Patent Application No. 1601306.2, 6 pages.
Australian Government, IP Australia, Examination Report No. 2 dated Jun. 26, 2017, issued in connection with Autralian Patent Application No. 2016202965, 2 pages.
Australian Government, IP Australia, Examination Report No. 3 dated Oct. 12, 2017, issued in connection with Australian Patent Application No. 2016202965, 3 pages.
Canadian Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 16171832.5, 7 pages.
Non-Final Office Action dated Oct. 18, 2017, issued in connection with U.S. Appl. No. 15/140,945, filed Apr. 28, 2016, 12 pages.
Notice of Allowance dated Jan. 16, 2018, issued in connection with U.S. Appl. No. 15/140,945, filed Apr. 28, 2016, 5 pages.
Notice of Allowance dated Feb. 13, 2018, issued in connection with U.S. Appl. No. 15/141,010, filed Apr. 28, 2016, 5 pages.
Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.
United Kingdom Intellectual Property Office, Search Report dated Aug. 16, 2017, issued in connection with Great Britain Patent Application No. 1607379.3, 6 pages.
United Kingdom Intellectual Property Office, Search Report dated Aug. 11, 2017, issued in connection with Great Britain Patent Application No. 1607380.1, 8 pages.

* cited by examiner

700

GAMING MACHINE WITH SYMBOL RESTRICTION

CROSS-REFERENCE TO RELATED APPLICATION

This application claims priority to U.K. patent application no. 1607380.1 filed Apr. 28, 2016, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For example, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine over the computer network. In this instance, the server machine may perform the spins of the game and may send the resulting symbols to the client machine for display.

The popularity of video slot games has increased due to the incorporation of novel features, such as a "Wild" symbol, into such games. A Wild symbol, which is usually the highest-ranking symbol of the game, offers line payouts, just like any other symbol and, additionally, substitutes for any other symbol in the game, thereby assisting in making winning results and providing a player with entertainment and additional opportunities to win games.

Viewed from a first aspect, the disclosure includes a gaming machine determining that a trigger event for a bonus game occurred during a base outcome event of a base game. The base game and the bonus game may be both reel-based games being executed on behalf of a client machine. Both the base game and the bonus game may involve spinning a plurality of reels, each reel containing a respective plurality of symbols, to determine outcome events. A memory of the gaming machine may store respective pluralities of symbols for the reels. Possibly in response to determining that the trigger event occurred, the gaming machine may award a number of spins of the reels in an instance of the bonus game. A symbol counter may be set to an initial value. Until the awarded number of bonus game spins have been performed, the gaming machine may repeatedly carry out iterations of bonus game operations including: (i) selecting, from the stored pluralities of symbols for the reels, a first symbol set or a second symbol set for display on the plurality of reels, where the first symbol set excludes a predetermined symbol, where the second symbol set includes a number of the predetermined symbol equivalent to the symbol counter, and where, when the second symbol set is selected, the symbol counter is incremented, and (ii) transmitting, to the client machine, a representation of the selected symbol set, where reception of the selected symbol set causes the client machine to display the bonus game spin of the plurality of reels resulting in the selected symbol set.

Viewed from a second aspect, the disclosure provides a gaming machine determining that a trigger event for a bonus game occurred during a base outcome event of a base game. The base game and the bonus game may both be reel-based games executed on behalf of a client machine. Further, both the base game and the bonus game may involve spinning a plurality of reels, each reel containing a respective plurality of symbols, to determine outcome events. A memory of the gaming machine may store respective pluralities of symbols for the reels. The disclosure further provides, possibly in response to determining that the trigger event occurred, awarding a number of spins of the reels in an instance of the bonus game. The bonus game may include a predetermined symbol, and a symbol counter may be set to an initial value. The disclosure also provides, until the awarded number of bonus game spins have been performed, repeatedly carrying out iterations of bonus game operations. These operations may include: (i) selecting, from the stored pluralities of symbols for the reels, a symbol set for display on the plurality of reels, where the selected symbol set represents an outcome of a bonus game spin of the plurality of reels, (ii) determining whether to replace symbols from the selected symbol set, where the replacement of symbols involves (a) replacing, with the predetermined symbol, a number of symbols from the selected symbol set equal to the symbol counter and (b) incrementing the symbol counter, and (iii) transmitting, to the client machine, a representation of the selected symbol set after replacement, where reception of the selected symbol set after replacement causes the client machine to display the bonus game spin of the plurality of reels resulting in the selected symbol set after replacement.

Viewed from a third aspect, the disclosure provides an article of manufacture including a non-transitory computer-readable medium, having stored thereon program instructions that, upon execution by a gaming machine, cause the gaming machine to perform the operations of the first and/or second aspect.

Viewed from a fourth aspect, the disclosure provides a gaming machine configured to perform the operations of the first and/or second aspect.

Viewed from a fifth aspect, the disclosure provides a system including means for performing the operations of the first and/or second aspect.

Viewed from a sixth aspect, the disclosure provides a gaming system. The gaming system may be configured for a reel-based game. The reel-based game may be executed on behalf of a client machine, and the reel-based game may involve spinning a plurality of reels to determine outcome events. The gaming system may comprise a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account. The gaming system may also include one or more gaming device processors, and one or more gaming device memory devices storing respective pluralities of symbols for the reels and a plurality of gaming device instructions. The gaming device instructions may be executable by the one or more gaming device processors to perform operations. These operations may involve determining that a trigger event for a bonus game occurred during a base outcome event of a base game, where the base game and the bonus game are both part of the reel-based game; possibly in response to determining that the trigger event occurred, awarding a number of spins of the reels in an instance of the bonus game, where a symbol counter is set to an initial value; and until the awarded number of bonus game spins have been performed, repeatedly carrying out iterations of bonus game operations involving: (i) selecting, from the stored pluralities of symbols for the reels, a first symbol set or a second symbol set for display on the plurality of reels, where the first symbol set excludes a predetermined symbol, where the second symbol set includes a number of the predetermined symbol equivalent to the symbol counter, and where, when the second symbol set is selected, the symbol counter is incremented, and (ii) transmitting, to the client machine, a representation of the selected symbol set, where reception of the selected symbol set causes the client machine to display the bonus game spin of the plurality of reels resulting in the selected symbol set.

Viewed from a seventh aspect, the disclosure provides a gaming system. The gaming system may be configured for symbol replacement in a reel-based game. The reel-based game may be executed on behalf of a client machine, and the reel-based game may involves spinning a plurality of reels to determine outcome events. The gaming system may comprise a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account. The gaming system may also include one or more gaming device processors, and one or more gaming device memory devices storing respective pluralities of symbols for the reels and a plurality of gaming device instructions, the gaming device instructions executable by the one or more gaming device processors to perform operations. These operations may involve determining that a trigger event for a bonus game occurred during a base outcome event of a base game, where the base game and the bonus game are both part of the reel-based game; possibly in response to determining that the trigger event occurred, awarding a number of spins of the reels in an instance of the bonus game, where the bonus game includes a predetermined symbol, and where a symbol counter is set to an initial value; and until the awarded number of bonus game spins have been performed, repeatedly carrying out iterations of bonus game operations involving: (i) selecting, from the stored pluralities of symbols for the reels, a symbol set for display on the plurality of reels, where the selected symbol set represents an outcome of a bonus game spin of the plurality of reels, (ii) determining whether to replace symbols from the selected symbol set, where the replacement of symbols involves (a) replacing, with the predetermined symbol, a number of symbols from the selected symbol set equal to the symbol counter and (b) incrementing the symbol counter, and (iii) transmitting, to the client machine, a representation of the selected symbol set after replacement, where reception of the selected symbol set after replacement causes the client machine to display the bonus game spin of the plurality of reels resulting in the selected symbol set after replacement.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines and methods for carrying out aspects of outcome events that include displaying symbols, such as games, in particular, wager games. In one aspect, the machines and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often maximize their profits simply by getting more players to play more games. Due to the provided feature, players may be drawn in (e.g., from competing casinos that lack games with such a feature) and they may play the game often. The feature can include new data communications between a server machine and a client machine within a server-client based configuration.

II. Example Architecture

Figure 1:
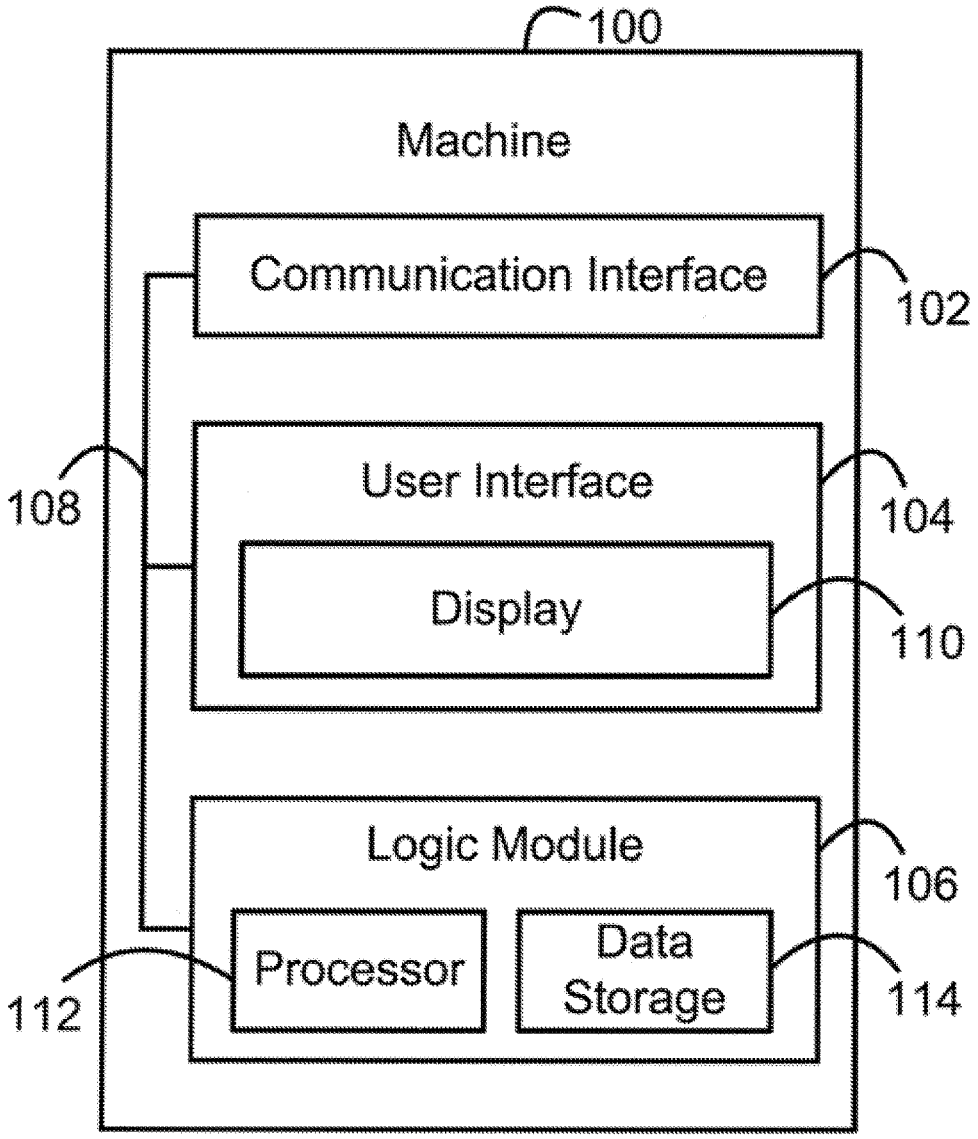
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad or a touch-sensitive screen. As described in greater detail below, display 110 may be configured to display, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
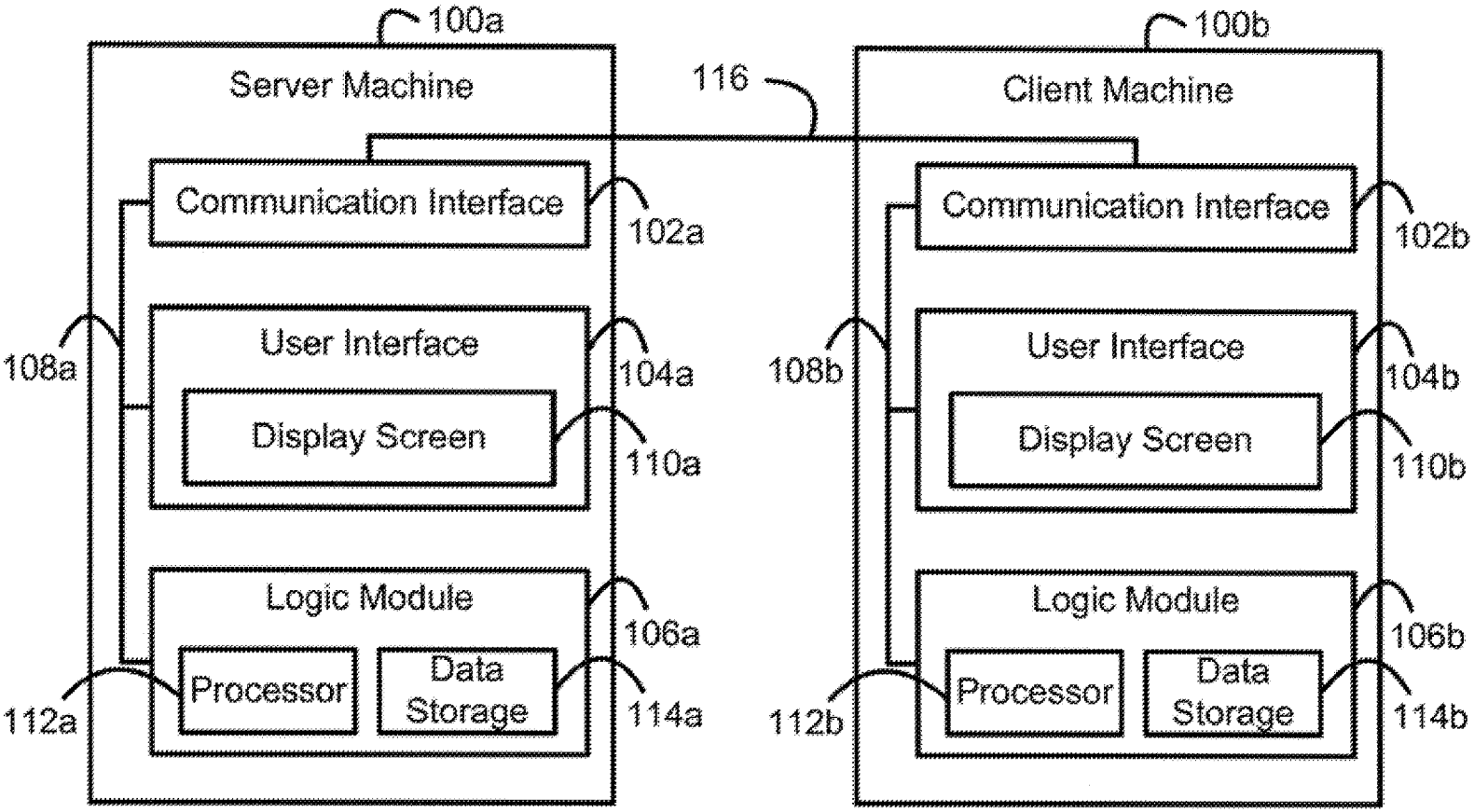
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a computer-network 116. A configuration of elements including server machine 100*a* and client machine 100*b* can be referred to as a server-client based configuration.

The components of the server machine 100*a* and the client machine 100*b* are shown with corresponding "a" and ""b"

reference numerals (i.e., based on machine 100). Server machine 100*a* includes communication interface 102*a*, user interface 104*a* (which incorporates display screen 110*a*), logic module 106*a*(which incorporates processor 112*a* and data storage 114*a*), and communication bus 108*a*. Likewise, client machine 100*b* includes communication interface 102*b*, user interface 104*b*(which incorporates display screen 110*b*), logic module 106*b*(which incorporates processor 112*b* and data storage 114*b*), and communication bus 108*b*.

The server machine 100*a* is configured to communicate with the client machine 100*b* over the computer-network 116 (via the communication interfaces 102*a*, 102*b*). Likewise, the client machine 100*b* is configured to communicate with the server machine 100*a* over the computer-network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The computer-network 116 for the server-client based configuration described above may take a variety of forms. For example, the computer-network 116 may be a local area network (LAN) in a casino, such that client machines 100*b* dispersed throughout the casino may communicate with the server machine 100*a* in the casino.

In another example, the computer-network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The computer-network 116 may include any of a variety of network topologies and network devices, and may employ traditional network-related technologies, including for example the public switched telephone network, cable networks, cellular wireless networks, WiFi, and WiMAX. Further, the computer-network 116 may include one or more databases (e.g., a player credit account database), to allow for the storing and retrieving of data related to performing an outcome event by a machine, as well as adjusting account balances associated with client machines.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Figure 5:
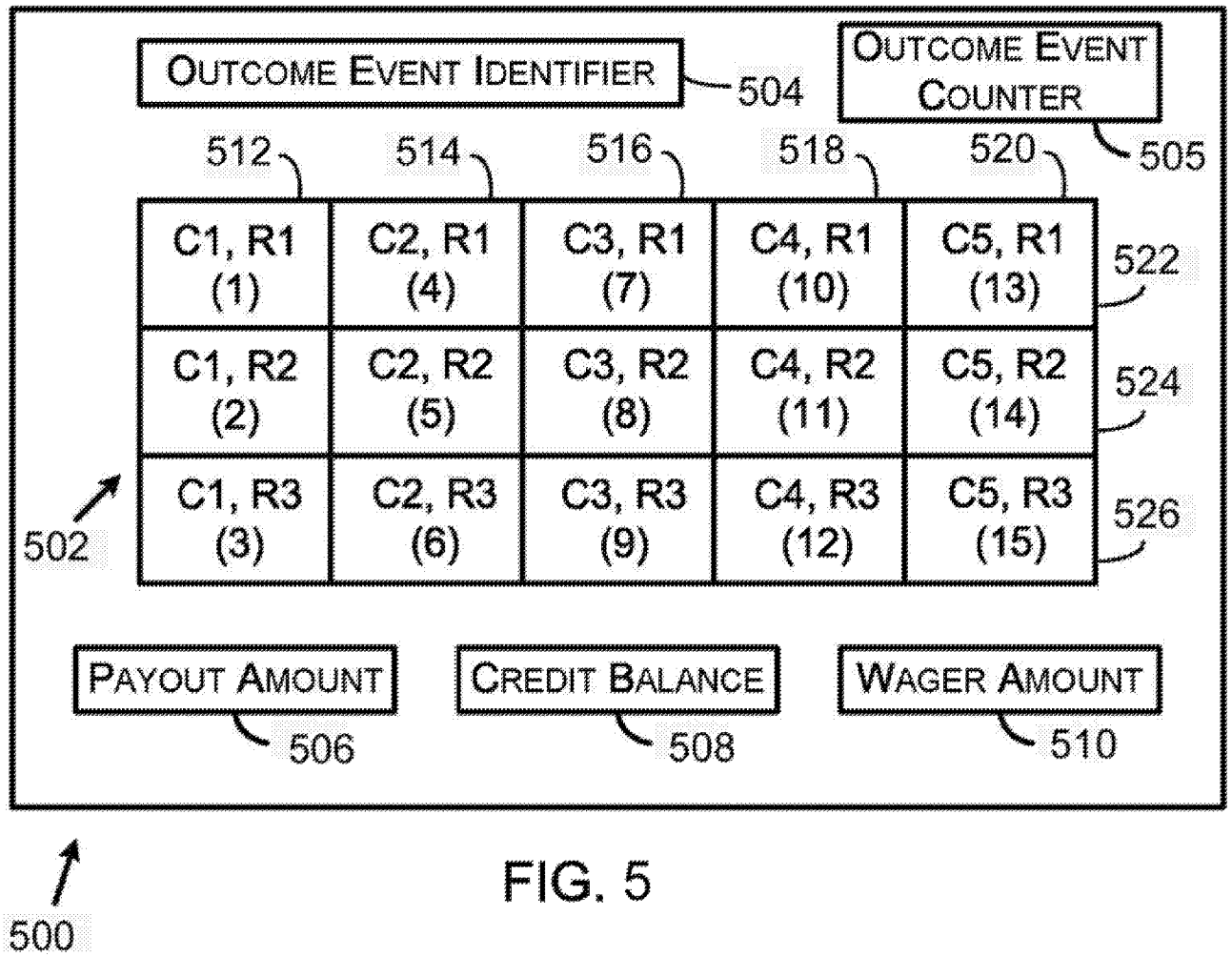
FIG. 5 depicts elements displayable by a display of a machine, in accordance with example embodiments.

Next, FIG. 5 depicts a screenshot 500 that machine 100, server machine 100*a*, or client machine 100*b* can visually present (i.e., display) using displays 110, 110*a*, and 110*b*, respectively. For purposes of this description, each element of screenshot 500 can be a displayable element of the display. Screenshot 500 includes a symbol-display-portion 502, an outcome event identifier 504, an outcome event counter 505, a payout amount indicator 506, a credit balance indicator 508, and a wager amount indicator 510.

Symbol-display-portion 502 can include multiple symbol-display-segments and multiple symbol positions. As an example, the symbol-display-segments can include vertical symbol-display-segments 512, 514, 516, 518, and 520 (or more simply, vertical SDS 512-520). As another example, the symbol-display-segments can include horizontal symbol-display-segments 522, 524, and 526 (or more simply, horizontal SDS 522-526). Each symbol-display-segment can include multiple symbol positions. The vertical SDS 512-520 are shown in FIG. 5 as having three symbol positions. The horizontal SDS 522-526 are shown in FIG. 5 as having five symbol positions. A person skilled in the art will understand that those symbol-display-segments can be configured with different numbers of symbol positions than shown in FIG. 5.

The vertical SDS 512-520 can be configured as spinnable reels. The processor of a machine or system displaying screenshot 500 can display the spinnable reels spinning and stopped after spinning. For vertical SDS 512-520, the spinnable reels may spin in a vertical direction (e.g., top to bottom or bottom to top, with respect to the symbol-display-portion 502).

The horizontal SDS 522-526 can be configured as spinnable reels. The processor of a machine or system displaying screenshot 500 can display the spinnable reels spinning and stopped after spinning. For horizontal SDS 522-526, the spinnable reels may spin in a horizontal direction (e.g., left to right or right to left, with respect to the symbol-display-portion 502).

The multiple symbol positions in symbol-display-portion 502 are identified by column and row designators, in which C=column 1, C2=column 2, C3=column 3, C4=column 4, C5=column 5, R1=row 1, R2=row 2, and R3=row 3. The multiple symbol positions in symbol-display-portion 502 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 5, C2 is between C1 and C3, C3 is between C2 and C4, and C4 is between C3 and C5.

For a matrix arrangement with 15 symbol positions as shown in FIG. 5, the numerical identifiers can be whole numbers 1 through 15, inclusive. The processors or machines described herein can be configured to select a symbol position of symbol-display-portion 502 using a random number generator that is configured to generate a number within the range 1 through N, inclusive, where N equals the number of symbol positions in symbol-display-portion 502. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 504 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 510, the determined payout amount to be displayed by the payout amount indicator 506, the determined credit balance to be displayed by the credit balance indicator 508, and the number of awarded remaining outcome events to be displayed by the outcome event counter 505.

III. Example Operations

Figure 3A:
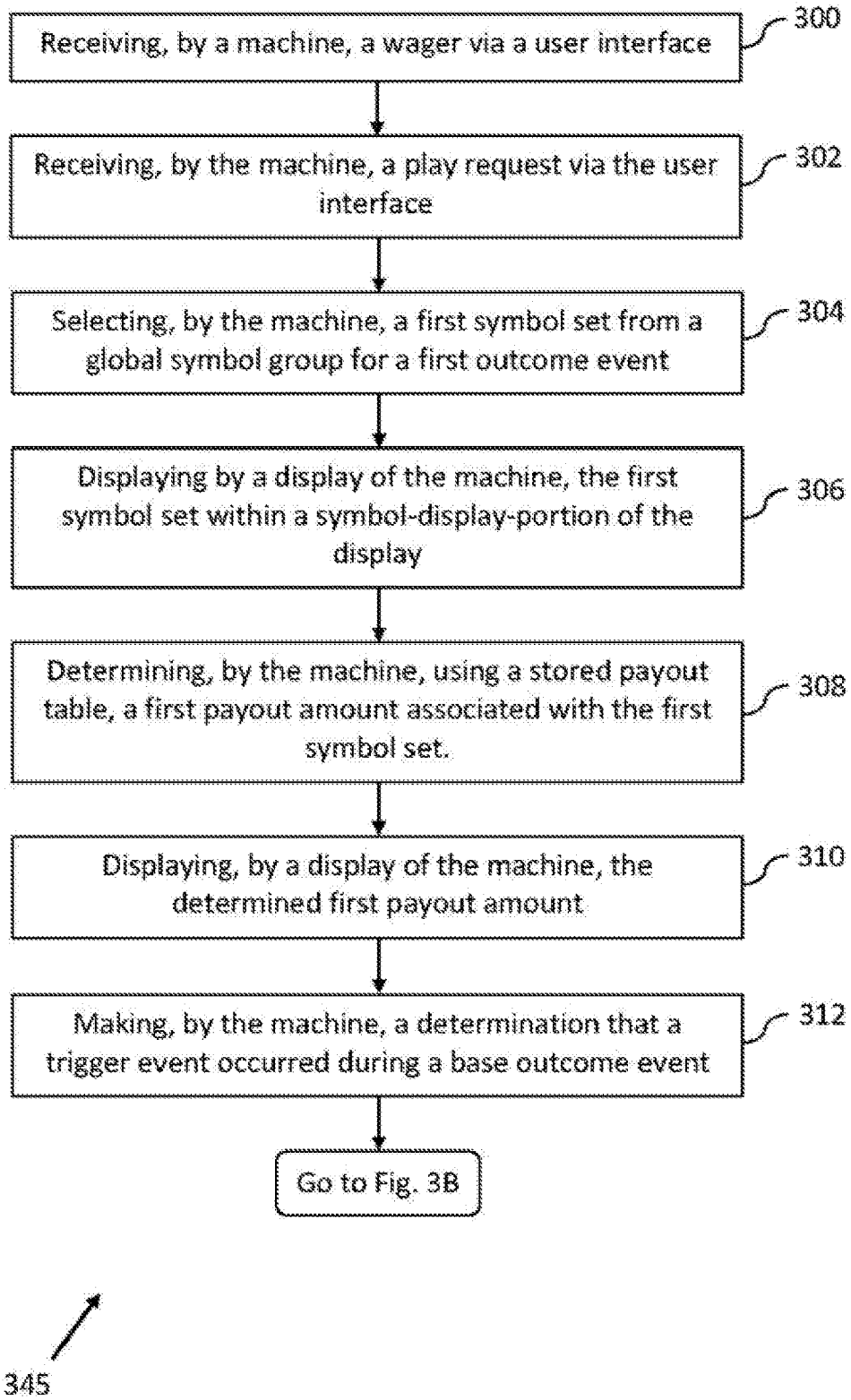
FIG. 3A is a first part of a flow chart, in accordance with example embodiments.
Figure 3B:
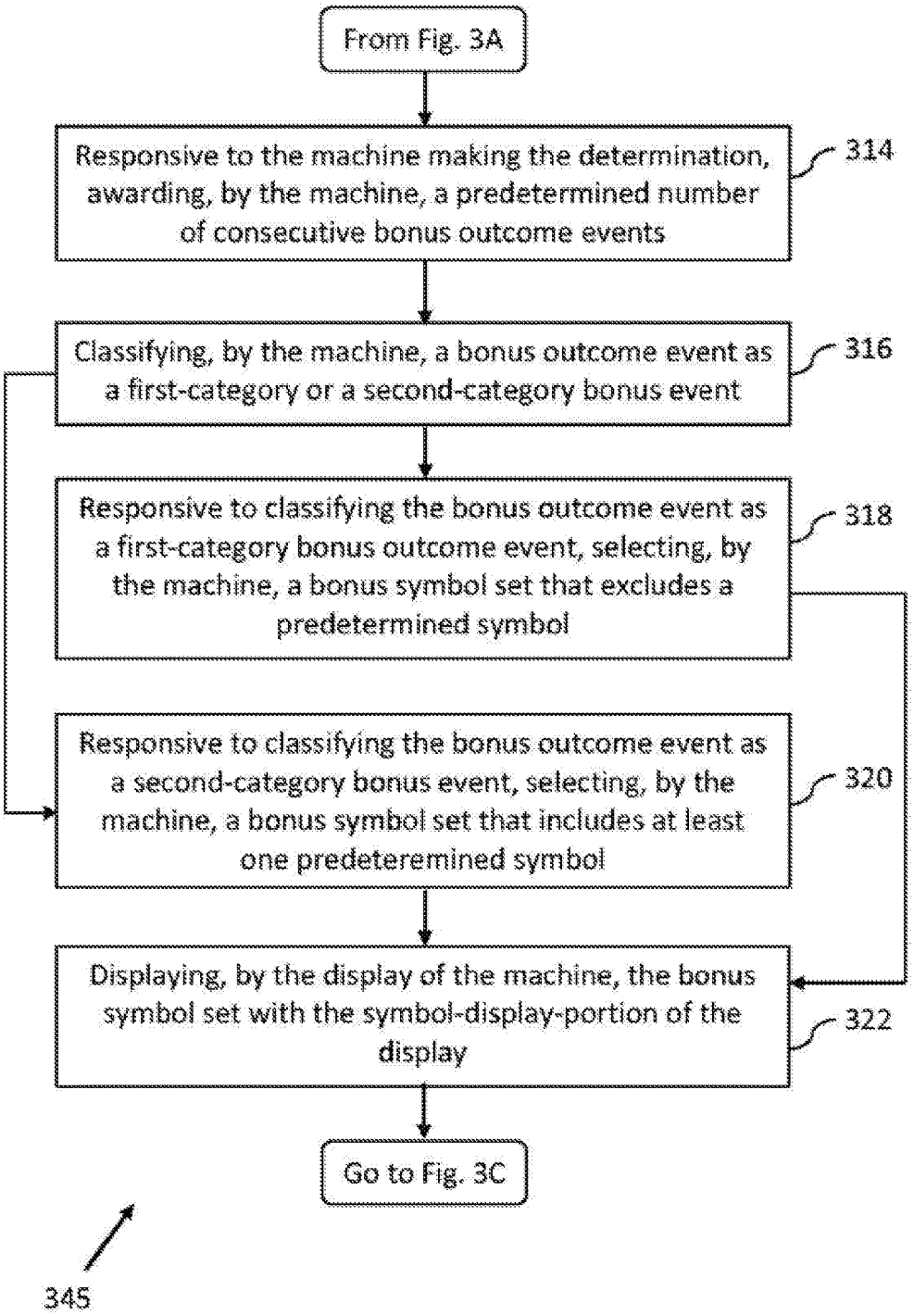
FIG. 3B is a second part of the flow chart of FIG. 3A, in accordance with example embodiments.
Figure 3C:
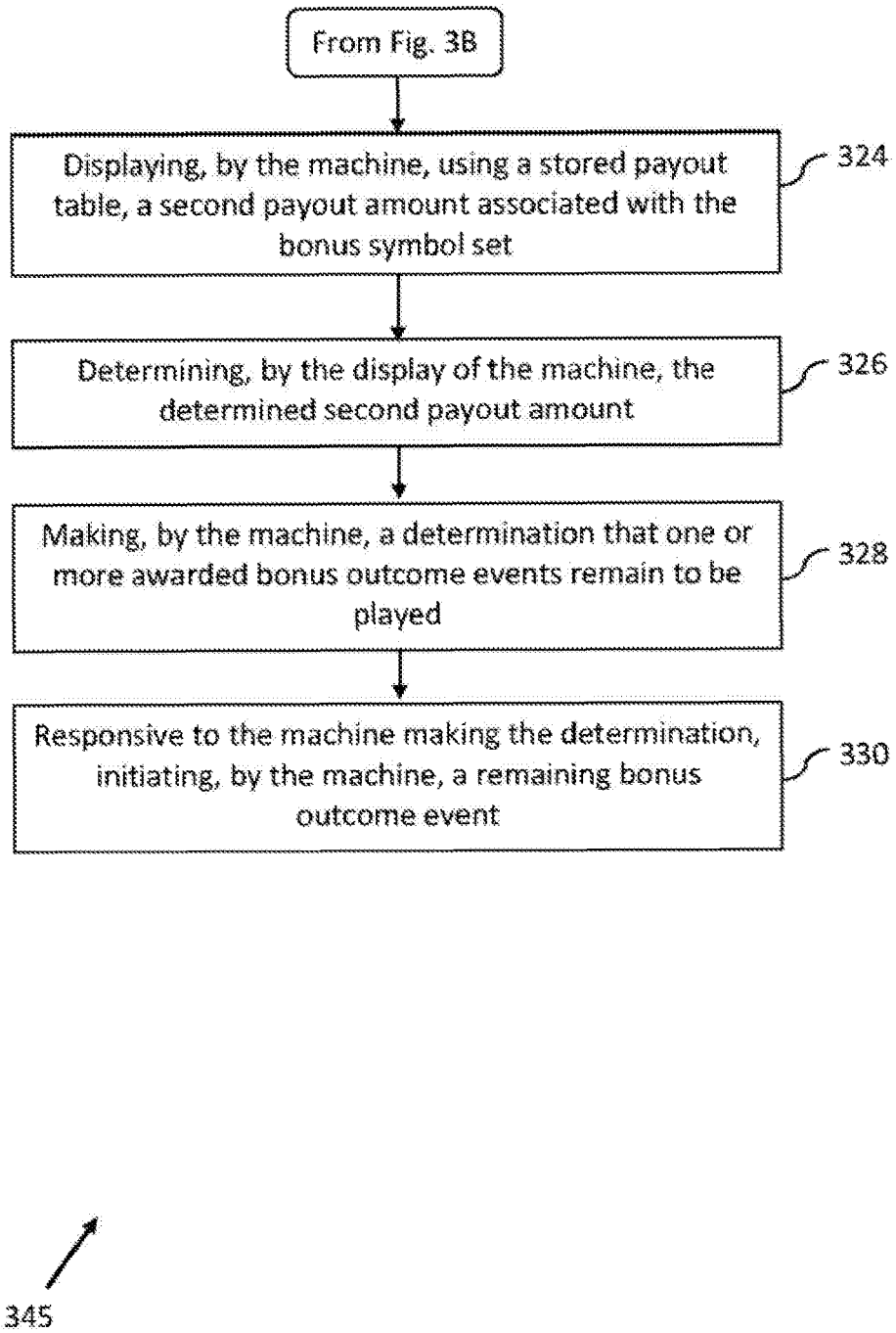
FIG. 3C is a third part of the flow chart of FIG. 3A, in accordance with example embodiments.

FIG. 3A, FIG. 3B and FIG. 3C (i.e., FIGS. 3A-3C) depict a flowchart showing a set of operations 345 (or more simply, "the set 345") that can, for example, be carried out using machine 100. Nonetheless, some or all of these operations may be carried out on server machine 100*a* and/or client machine 100*b*.

The operations of the set 345 are shown within blocks labeled with even integers between 300 and 330, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 345, unless context clearly dictates otherwise. Those other operation(s) can be performed in combination with or separately from any one or more of the operations of the set 345. Any operation described below, or elsewhere in this description, with respect to FIGS. 3A, 3B and 3C, can be performed, at least in part, by a processor, such as processor 112 executing software program instructions.

Turning to FIG. 3A, block 300 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 508, possible wager amounts in wager amount indicator 510, and a received wager amount in wager amount indicator 510.

Next, block 302 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 304 includes selecting, by machine 100, a first symbol set to display within the symbol-display-portion 502 of display 110 for the outcome event. Selecting the first symbol set can include processor 112 carrying out a random selection, such as a random selection of the first symbol set from a global symbol group.

Figure 6:
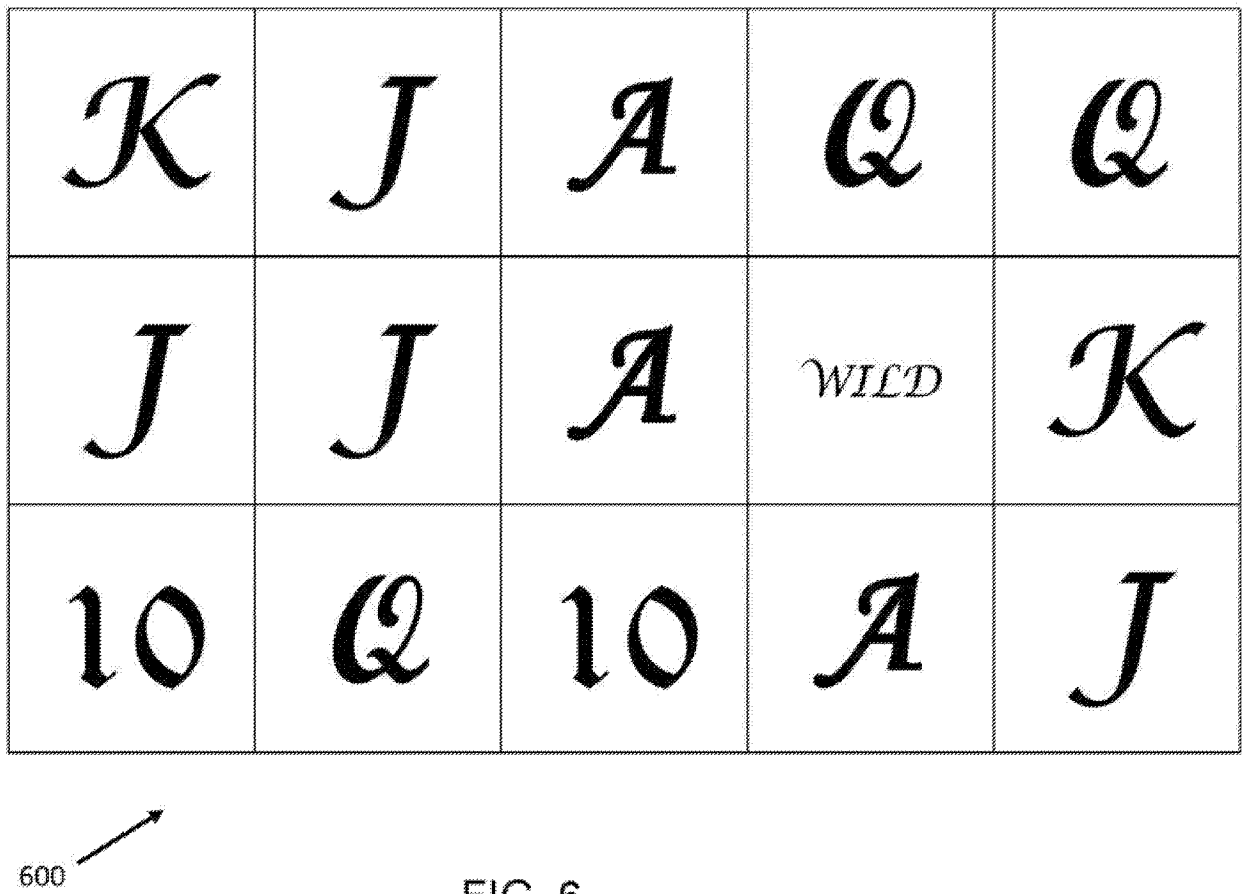
FIG. 6 depicts a selected first symbol set in a display, in accordance with example embodiments.

The global symbol group can include multiple symbols, such as a Wild, an Ace, a King, a Queen, a Jack and a Ten that may be used in connection with the outcome event, such as a wager game. The Ace, King, Queen, Jack and Ten symbols can represent symbols found on a standard deck of playing cards. FIG. 6 depicts examples of the aforementioned symbols and examples of other symbols that can be a part of the global symbol group. The global symbol group may be customized with particular symbols as desired.

Figure 4:
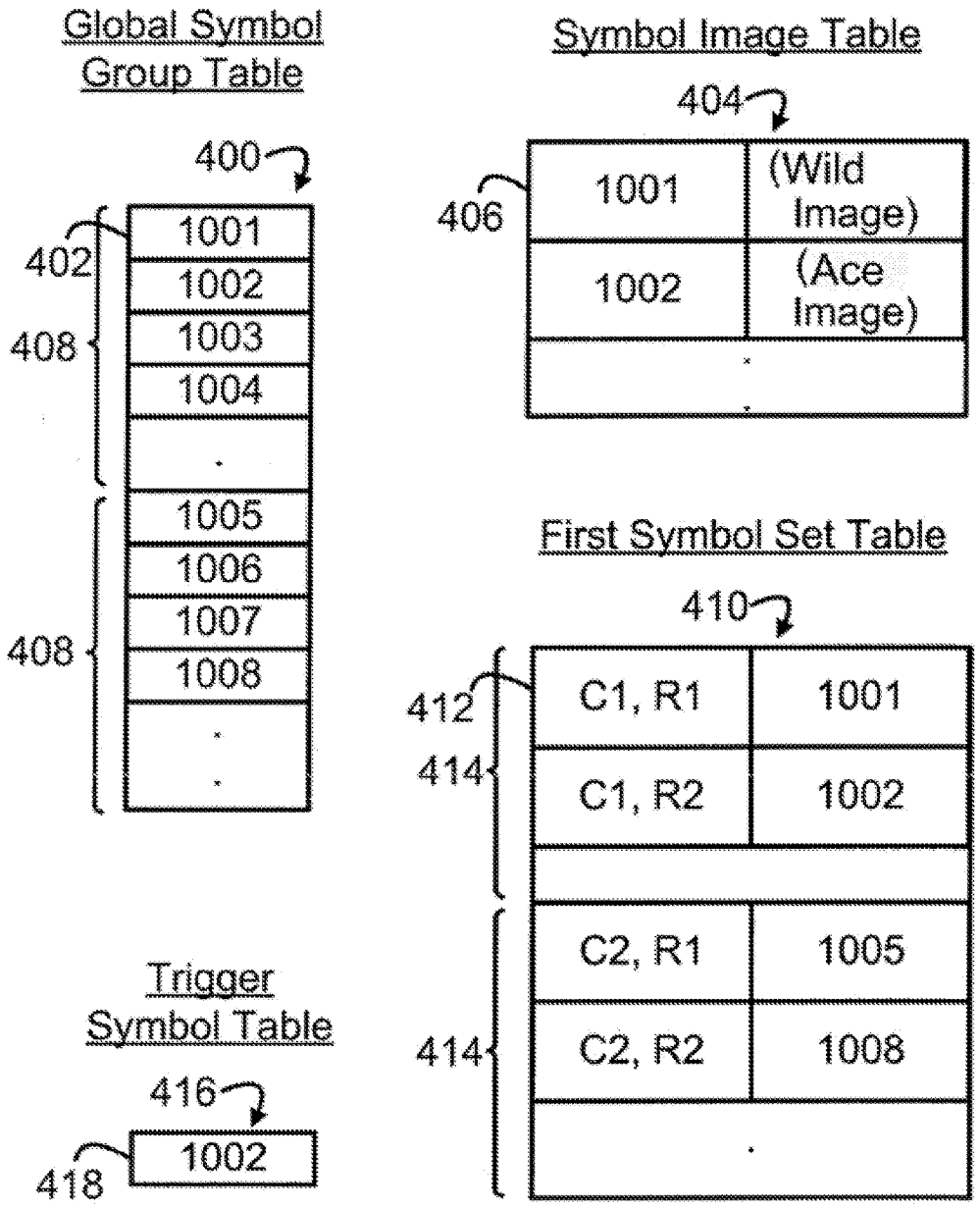
FIG. 4 depicts diagrams of tables that may be used with the processes, machines, and systems herein, in accordance with example embodiments.

In one example, the global symbol group may be represented as a table (or other data structure) stored in data storage 114. FIG. 4 shows an example global symbol group table 400. The global symbol group table 400 includes multiple records 402, each including an identifier (e.g., 1001, 1002, 1003 1004, etc.) that represents a particular symbol. In one example, the global symbol group, and therefore the global symbol table 400, may be divided into multiple sub-groups 408 as discussed in greater detail below.

The global symbol group table 400 may be used in connection with a symbol image table 404. The symbol image table 404 includes multiple records 406 (shown as distinct rows of table 404), each including an identifier that represents a particular symbol, and a corresponding displayable image. As such, the symbol image table 404 may be used to map an identifier in the global symbol group table 400 to a displayable image.

The selected first symbol set may be represented by a first symbol set table 410. The first symbol set table 410 includes multiple records 412 (shown as distinct rows in table 410), each record including an arrangement position of the symbol, and an identifier that represents the symbol. As such, each symbol in the selected first symbol set may correspond with a respective arrangement position in an arrangement (e.g. both a column number and a row number in a column-and-row arrangement). As an example, C1, R1, shown in the first symbol set table 410, represents a symbol position at column 1 (e.g., a left-most column of a plurality of columns in a symbol-display-portion 502 of display 110) and row 1 (e.g., a top row of a plurality of rows in a symbol-display-portion 502 of display 110). The column identifiers in table 410 (e.g., C1 and C2) can refer to columns in a symbol matrix or reels of a plurality of reels that can be spun.

In one example, machine 100 may select the first symbol set by iterating through each record 412 in the first symbol set table 410, and selecting a symbol identifier from among the symbol identifiers in the global symbol group table 400. In one example the symbol identifiers are numbers and machine 100 uses a random number generator to select such numbers, and therefore to randomly select symbols.

In one example, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play", namely those included in the selected first symbol set.

In one example, the first symbol set may be partially restricted. For instance, the first symbol set may include an instance of a predetermined symbol from the global symbol group, for example, a Wild symbol. In another example, the predetermined symbol may be in a subgroup of global symbol group table 400 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Further, a sub-group 408 may represent an ordering of symbols on a particular reel.

Returning to FIG. 3A, block 306 includes displaying, by the machine 100 on the symbol-display-portion of the display 110, the selected first symbol set.

Next, block 308 includes determining, by machine 100, using a stored payout table (not shown), a first payout amount, where the first payout amount is a function of the selected first symbol set and the received wager. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set.

Next, block 310, includes displaying, by display 110 of machine 100, the determined first payout amount. For example, where machine 100 has determined, using the stored payout table, a first payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

In one example, machine 100 may also physically dispense a corresponding payout (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

FIG. 6 shows an example of a first symbol set 600 from the global symbol group for display during a base outcome event. The displayed first symbol set 600 includes (i) a single Wild symbol at arrangement position C4,R2; (ii) three Ace symbols at arrangement positions C3,R1 and C3,R2 and C4,R3; (iii) a pair of King symbols at arrangement positions C1,R1 and C5,R2; (iv) three Queen symbols at arrangement positions C4,R1 and C5,R1 and C2,R3; (v) four Jack symbols at arrangement positions C2,R1 and C1,R2 and C2,R2 and C5,R3; and (vi) two Ten symbols at arrangement positions C1,R3 and C3,R3.

Next, block 312 includes making, by machine 100, a determination that a trigger event occurred. The trigger event can be a randomly occurring event, such as an event that randomly occurs during performance of at least some base outcome events. For example, occurrence of the trigger event can include the presence of at least one trigger symbol in the first symbol set, such as in connection with a previous play of the game (e.g., a base outcome event). Similar to the selection of the first symbol set, in one example, machine 100 may use a random number generator to select the trigger symbol from the global symbol group. In another example, the trigger symbol may be non-randomly selected, such as selecting by a user (e.g. a player, machine designer or casino personnel). In another example, the trigger symbol may be predetermined, for example a Wild symbol.

Making the determination that the trigger event occurred can take place while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110.

Turning to FIG. 3B, block 314 includes, responsive to machine 100 making the determination (i.e., the determination made at block 312), awarding, by machine 100, a bonus feature of the game. For example, the bonus feature may be a predetermined number of consecutive plays (e.g., spins and/or patterns of symbols being displayed) of outcome events. The awarded outcome events can be bonus outcome events, such as a game or a wager game. The predetermined number of consecutive outcome events can be conditioned upon a combination of symbols displayed by display 110 as a result of playing a base outcome event. Machine 100 can cause outcome event identifier 504 to identify the bonus outcome event awarded (e.g., a "free spins" bonus) and to cause the outcome event counter 505 to display the predetermined number.

Furthermore, in response to making the determination at block 312, machine 100 can transition from operating in the first state to operating in a second machine state (or more simply, the second state). Machine 100 can be configured such that, while machine 100 is operating in the second state, machine 100 allows the player to play bonus outcome events in which sets of symbols selected from a global symbol group can be selected by processor 112 and displayed by display 110. In accordance with an embodiment in which the symbol-display-portion includes 15 symbol positions, selecting a set of symbols for a bonus outcome event can include selecting 15 symbols.

Machine 100 can be configured to transition from operating in the second state back to operating in the first state. This transition can occur in response to machine 100 determining any of a variety of trigger events, such as, but not limited to, occurrence of all of the awarded predetermined number of consecutive plays of the outcome event, or a player stopping play of machine 100 while one or more of the awarded predetermined number of consecutive plays of the outcome event remain to occur. Machine 100 can be configured to store a number indicating any remaining consecutive plays of the outcome event and to allow a player awarded the consecutive plays to commence playing any remaining consecutive plays of the outcome event at a time after the player stops performing (e.g., playing) the outcome events.

Next, block 316 includes classifying, by the machine 100, a bonus outcome event as either a first-category or a second-category bonus outcome vent. The classification of the bonus outcome event may be determined randomly by the machine 100. A bonus symbol set selected for display in a first-category bonus outcome event (more simply, a "first-category bonus symbol set") may be restricted to exclude any instance of a predetermined symbol from the global symbol group, whereas a bonus symbol selected for display in a second-category bonus outcome event (more simply, a "second-category bonus symbol set) may be restricted to include at least one instance of the predetermined symbol from the global symbol group.

Block 318 includes, responsive to classifying the bonus outcome event as a first-category event, selecting, by the machine 100, a first-category bonus symbol set that excludes any instance of the predetermined symbol.

Figure 7:
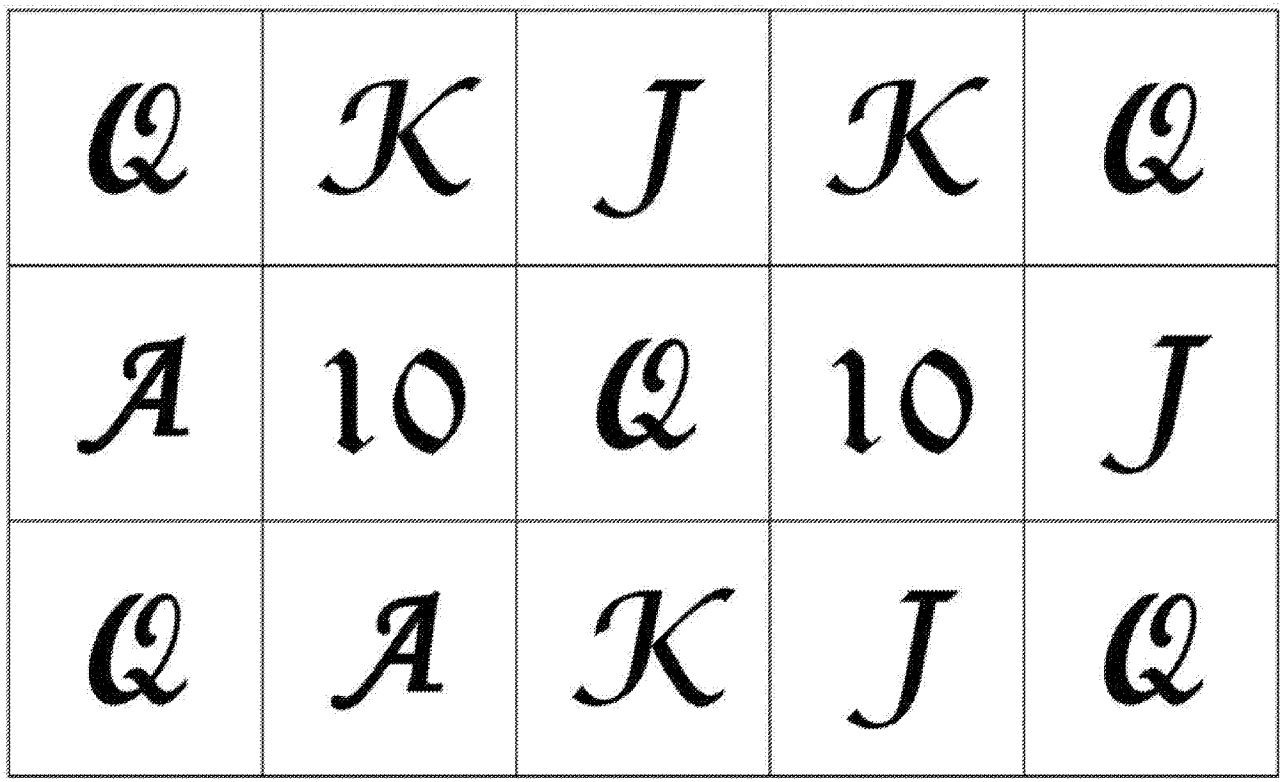
FIG. 7 depicts a selected bonus symbol set in a display, in accordance with example embodiments.

In one example, where the predetermined symbol in the global symbol group is the Wild symbol, FIG. 7 shows an example of a first-category bonus symbol set 700 selected from the global symbol group. The first-category bonus symbol set 700 consists of (i) two Ace symbols at arrangement positions C1,R2 and C2,R3; (ii) three King symbols at arrangement positions C2,R1 and C4,R1 and C3,R3; (iii) five Queen symbols at arrangement positions C1, R1, C5,R1 and C3,R2 and C1,R3 and C5,R3; (iv) three Jack symbols at arrangement positions C3,R1 and C5,R2 and C4,R3; and two Ten symbols at arrangement positions C2,R2 and C4,R2. Notably, the first-category bonus symbol set 700 does not include an instance of a Wild symbol.

Block 320 includes, responsive to classifying the bonus outcome event as a second-category event, selecting, by the machine 100, a second-category bonus symbol set that includes at least one instance of the predetermined symbol.

Figure 8:
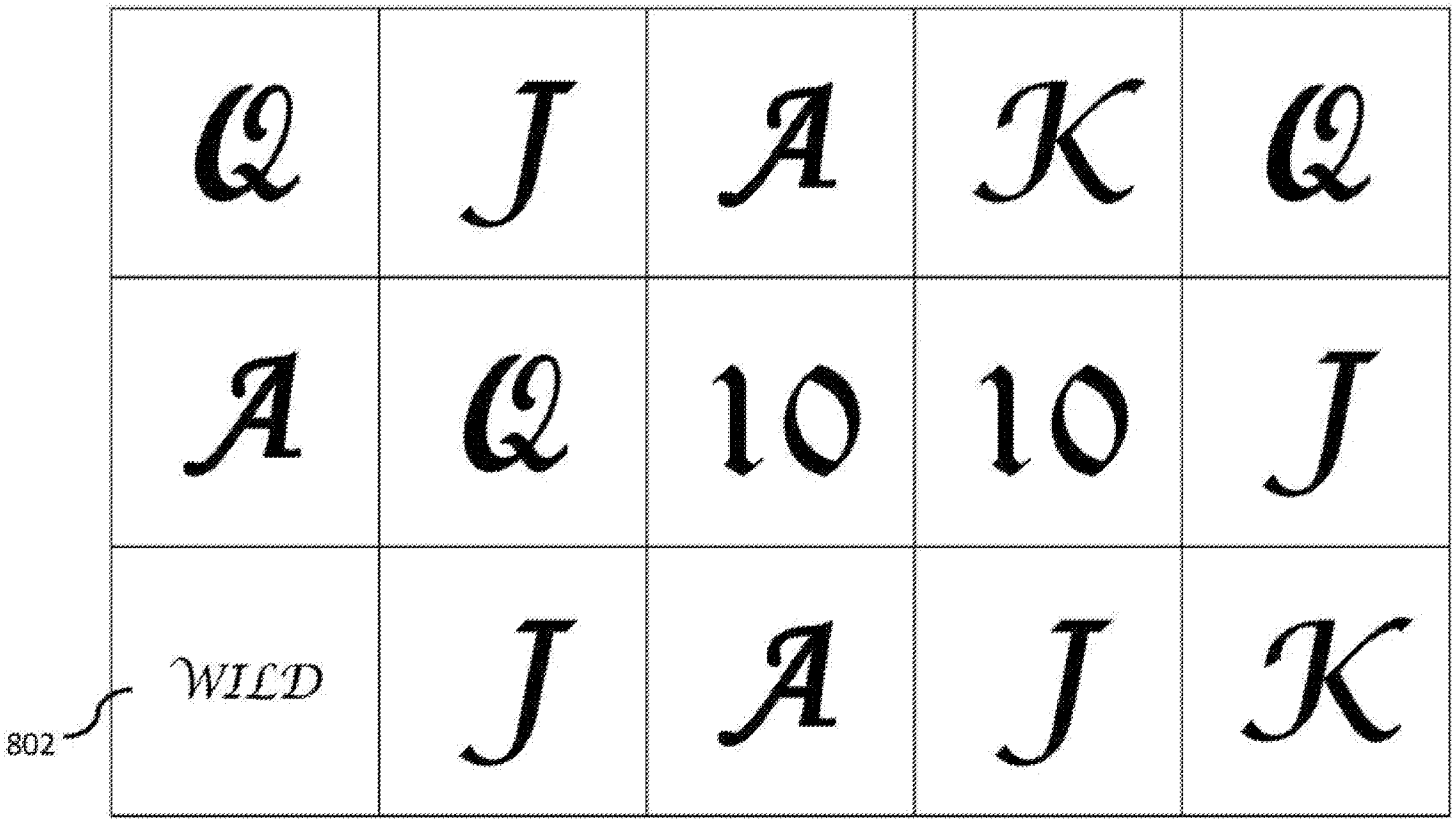
FIG. 8 depicts another selected bonus symbol set in a display, in accordance with example embodiments.

In the same example as above, where the predetermined symbol in the global symbol group is the Wild symbol, FIG. 8 shows an example of a second-category bonus symbol set 800 selected from the global symbol group. The second-category bonus symbol set 800 contains a single instance 802 of the Wild symbol, at arrangement position C1,R3.

For the awarded number of bonus outcome events, the number of instances of the predetermined symbol in a second-category bonus symbol set for a second-category bonus outcome event may be greater than the number of instances of the predetermined symbol in second-category symbol sets for any preceding second-category bonus outcome event.

Figure 9:
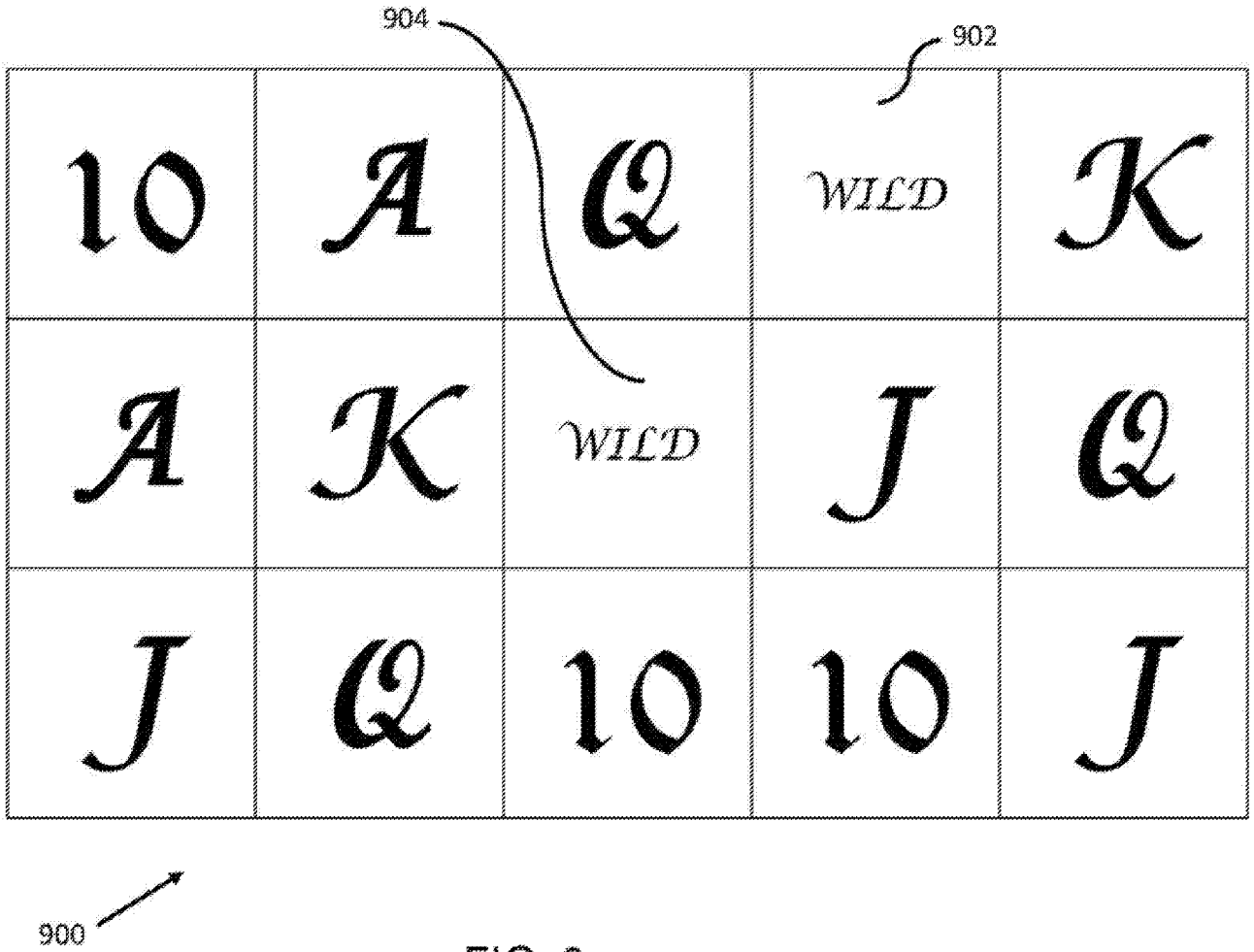
FIG. 9 depicts another selected bonus symbol set in a display, in accordance with example embodiments.

In the same example as above, where the predetermined symbol in the global symbol group is the Wild symbol, FIG. 9 shows an example of a second-category bonus symbol set 900 selected from the global symbol group for the next-occurring second-category bonus outcome event after that of FIG. 8. Whereas the bonus symbol set of FIG. 8 includes a single instance 802 of the Wild symbol, the bonus symbol set illustrated in FIG. 9 includes two instances 902 and 904 of the Wild symbol.

Figure 10:
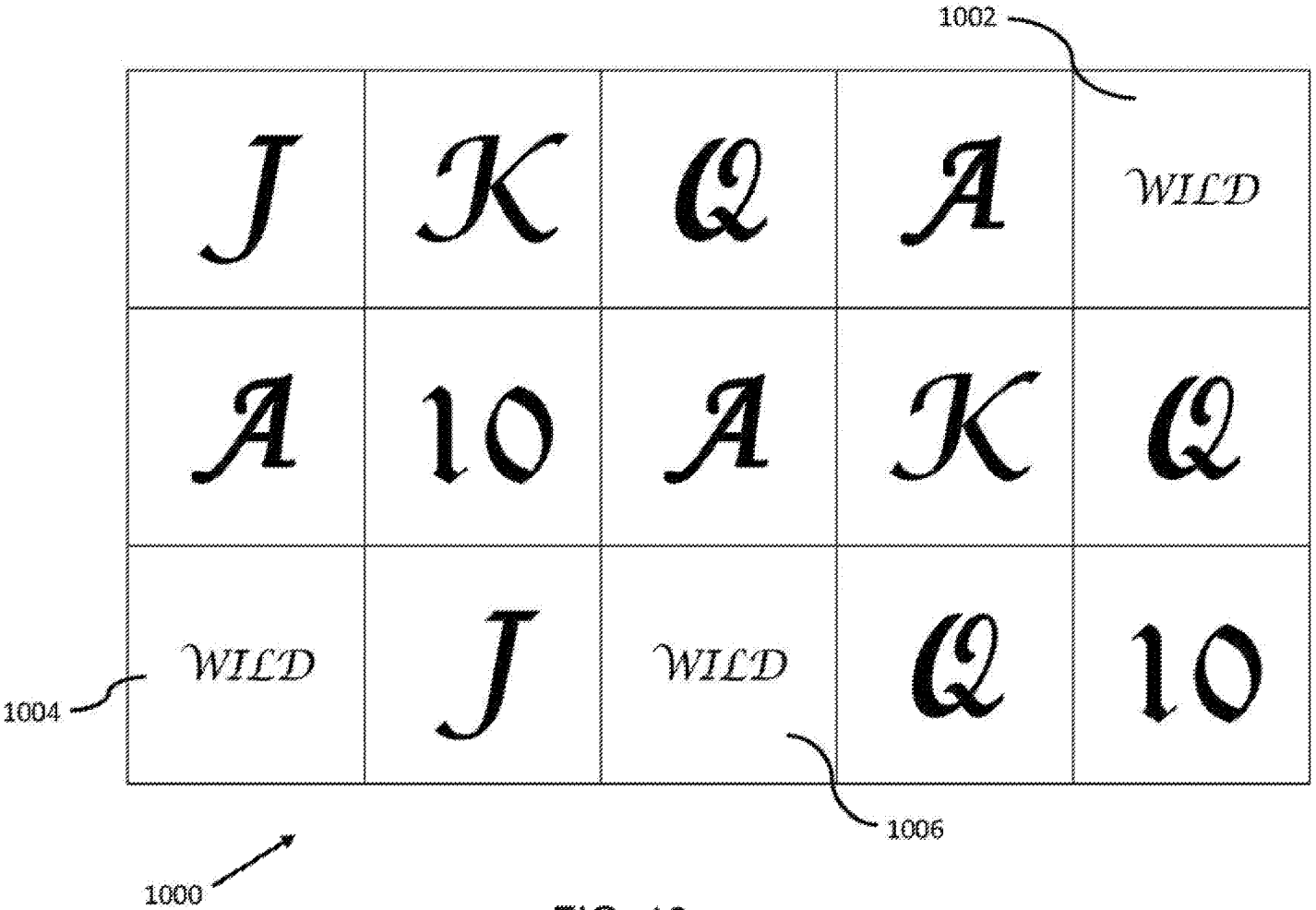
FIG. 10 depicts another selected bonus symbol set in a display, in accordance with example embodiments.

Similarly, FIG. 10 shows an example of a second-category bonus symbol set 1000 selected from the global symbol group for the next-occurring second-category bonus outcome event after that of FIG. 9. Whereas the bonus symbol set of FIG. 9 includes two instances 902 and 904 of the Wild symbol, the bonus symbol set illustrated in FIG. 10 includes three instances 1002, 1004 and 1006 of the Wild symbol.

Next, block 322 includes displaying, by the machine 100 on the symbol-display-portion of the display 110, the selected bonus symbol set.

Turning to FIG. 3C, block 324 includes determining, by machine 100, a second payout amount. In one example, the second payout amount may be determined randomly by machine 100. In another example, the second payout amount may be determined by the machine 100 using a stored payout table (not shown) as a function of the received wager and the symbols in the displayed bonus symbol set.

Next, block 326 includes displaying, on the display 110, the determined second payout amount. In one example, the machine 100 may also physically dispense a corresponding payout amount (e.g., cash), or otherwise facilitate the payout to the player (by adding funds to an electronic account associated with a gaming card).

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 502 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

Notably, the operations of selecting replacing, reordering, adding, and/or removing symbols from a reel of a reel-based game (e.g., the operations of blocks 316-320, 1118-1122, 1306, and 1406 as just some possible examples), necessitate computer implementation. In a mechanical reel-based game, the symbols appearing on each reel are fixed and cannot be changed mid-game. In contrast, the computer implementation herein allows the symbols on the reels to be changed, replaced, and/or re-ordered. These changes can occur mid-game, for example between spins of the reels. For instance, at block 318, a bonus symbol set excluding a predetermined symbol is selected, whereas at block 320, a bonus symbol set including the predetermined symbol is selected. These two bonus symbol sets are different, require different symbols on the reels, and thus could not both be supported using a mechanical reel-based game. Consequently, these features of the disclosure herein would not exist but for computer technology.

Further, these features are an improvement to reel-based gaming technology.

Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

Next, block 328 includes making, by machine 100, a determination that one or more awarded bonus outcome events remain to be played. In this case, the bonus game has not yet terminated.

Next, block 330 includes, possibly responsive to making the determination, initiating, by machine 100, a remaining bonus outcome event. Blocks 316-330 may continue until the bonus game terminates (e.g., there are no remaining bonus outcome events).

IV. Additional Example Operations

Figure 11A:
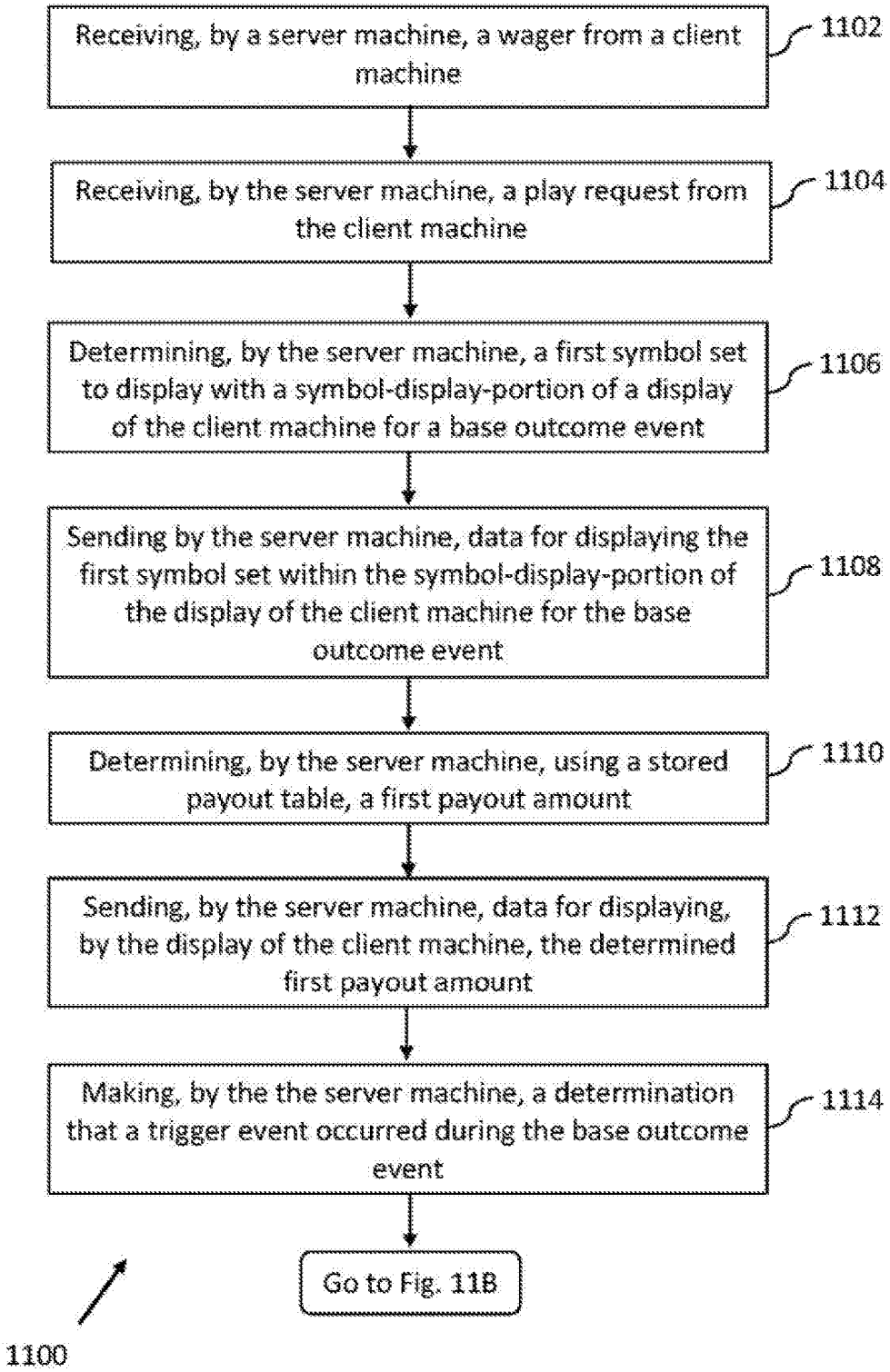
FIG. 11A is a first part of a flow chart, in accordance with example embodiments.
Figure 11B:
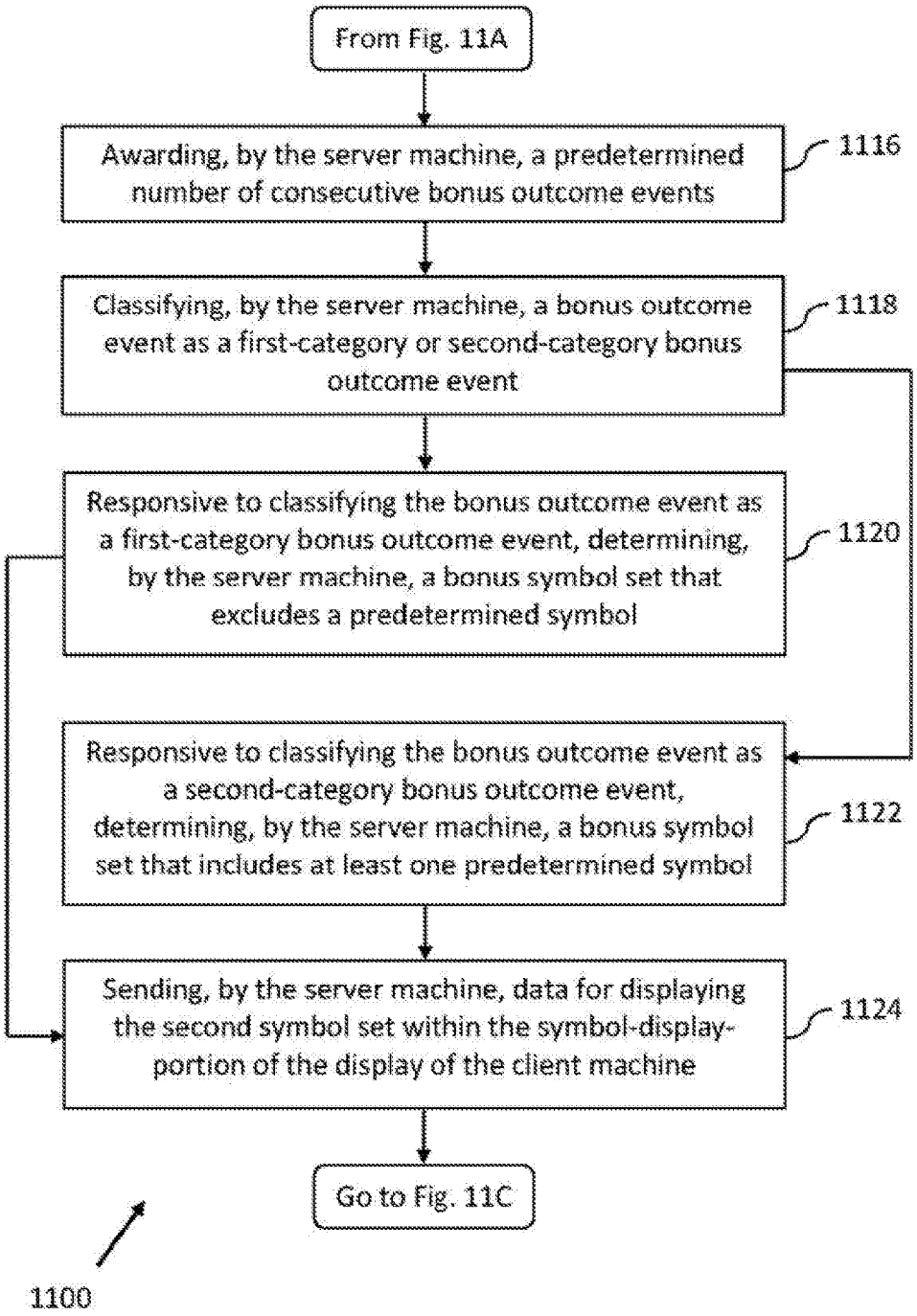
FIG. 11B is a second part of the flow chart of FIG. 11A, in accordance with example embodiments.

FIGS. 11A-11B depict a flowchart showing a set of operations 1100 (or more simply, "the set 1100") that can, for example, be carried out using server machine 100*a*. Note that several of the operations described in connection with FIG. 11A-11B parallel operations described in connection with FIG. 3A-3C. As such, variations of the operations described in connection with FIG. 3A-3C are likewise applicable to the operations described in connection with FIG. 11A-11B. However, for the sake of brevity, these variations are not repeated. The server machine 100*a*, in performing the set 1100, can perform the operations described above with respect to machine 100.

Turning to FIG. 11A, block 1102 includes receiving, by the server machine 100*a*, a wager from the client machine 100*b*.

Next, block 1104 includes receiving, by the server machine 100*a*, a play request from the client machine 100*b*.

Next, block 1106 includes determining, by the server machine 100*a*, a first symbol set to display within the symbol-display-portion of the display 110*b* of the client machine 100*b* for a base outcome event.

Next, block 1108 includes sending, by the server machine 100*a*, data for displaying, by the display 110*b* of the client machine 100*b*, the first symbol set within the symbol-display-portion of the display.

Next, block 1110 includes determining, by the server machine 100*a* using a stored payout table, a first payout amount associated with the first symbol set.

Next, block 1112 includes sending, by the server machine 100*a*, data for displaying, by the display 110*b* of the client machine 100*b*, the determined first payout amount.

Next, block 1114 includes making, by the server machine 100*a*, a determination that a trigger event occurred during the base outcome event.

Turning to FIG. 11B, block 1116 includes awarding, by the server machine 100*a*, a predetermined number of consecutive bonus outcome events.

Next, block 1118 includes classifying, by the server machine 100*a*, a bonus outcome event as a first-category or second-category bonus outcome event.

Block 1120 includes, responsive to classifying the bonus outcome event as a first-category bonus outcome event, determining, by the server machine 100*a*, a bonus symbol set that excludes a predetermined symbol from the global symbol group.

Block 1122 includes, responsive to classifying the bonus outcome event as a second-category bonus outcome event, determining, by the server machine 100*a*, a bonus symbol set that includes at least one predetermined symbol from the global symbol group.

Next, block 1124 includes sending, by the server machine 100*a*, data for displaying, by the display 110*b* of the client machine 100*b*, the bonus symbol set within the symbol-display-portion of the display.

Figure 11C:
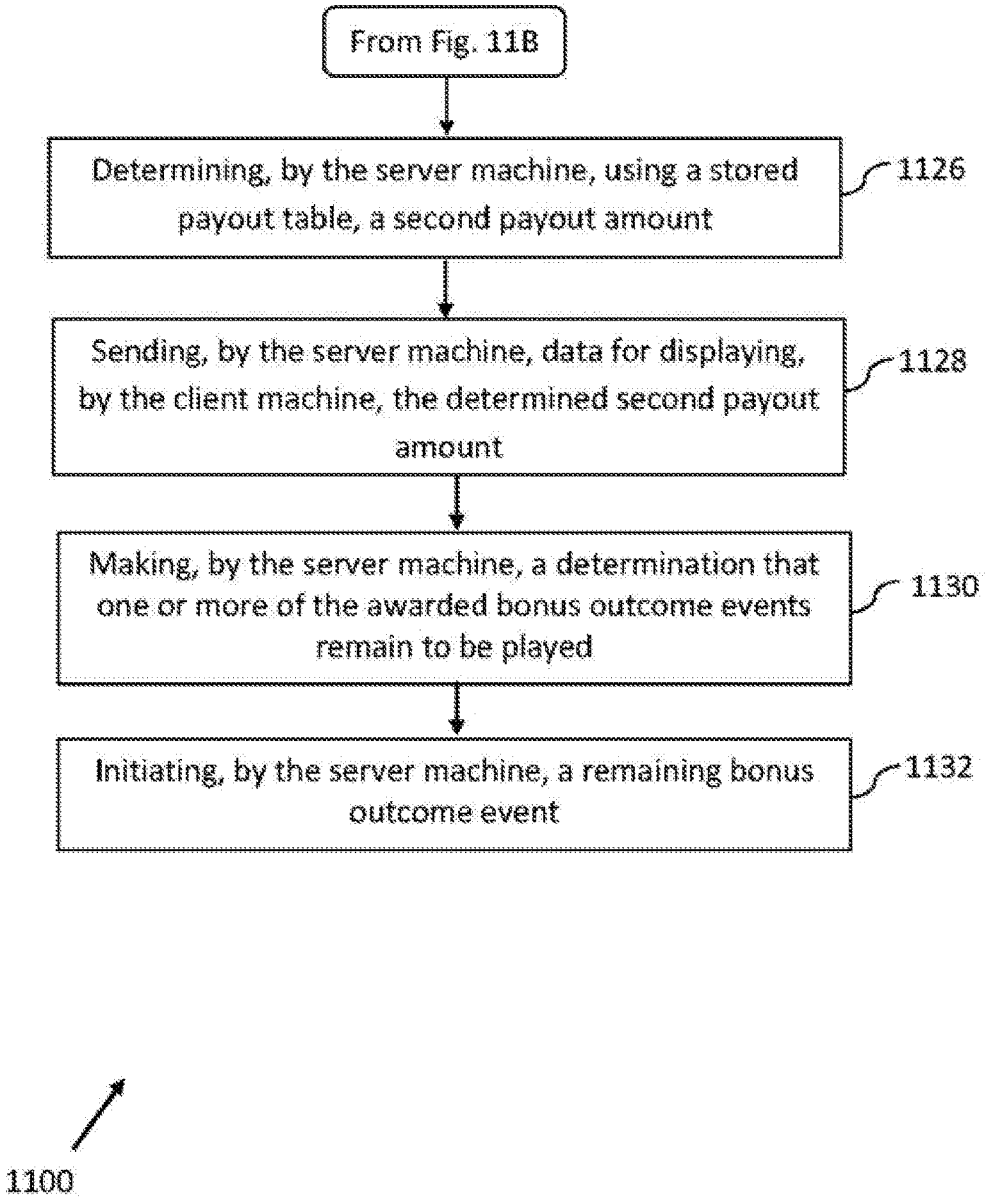
FIG. 11C is a third part of the flow chart of FIG. 11A, in accordance with example embodiments.

Turning to FIG. 11C, block 1126 includes determining, by the server machine 100*a*, using a stored payout table, a second payout amount associated with the bonus symbol set.

Next, block 1128 includes sending, by the server machine 100*a*, data for displaying, by the display device 110*b* of the client machine 100*b*, the determined second payout amount.

Next, block 1130 includes making, by the server machine 100*a*, a determination that one or more of the awarded bonus outcome events remain to be played.

Next, block 1132 includes initiating, by the server machine 100*a*, a remaining bonus outcome event.

Figure 12A:
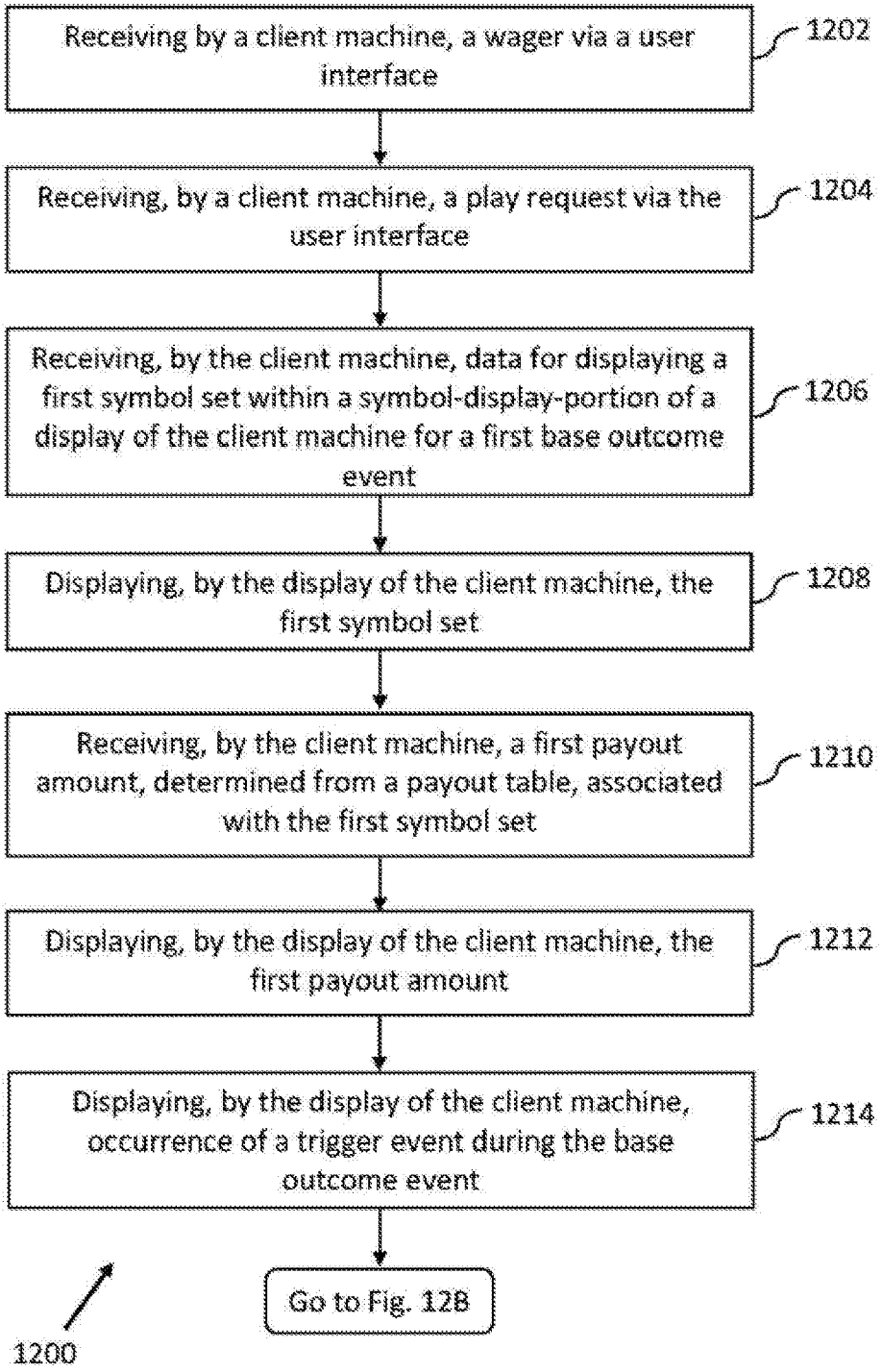
FIG. 12A is a first part of a flow chart, in accordance with example embodiments.
Figure 12B:
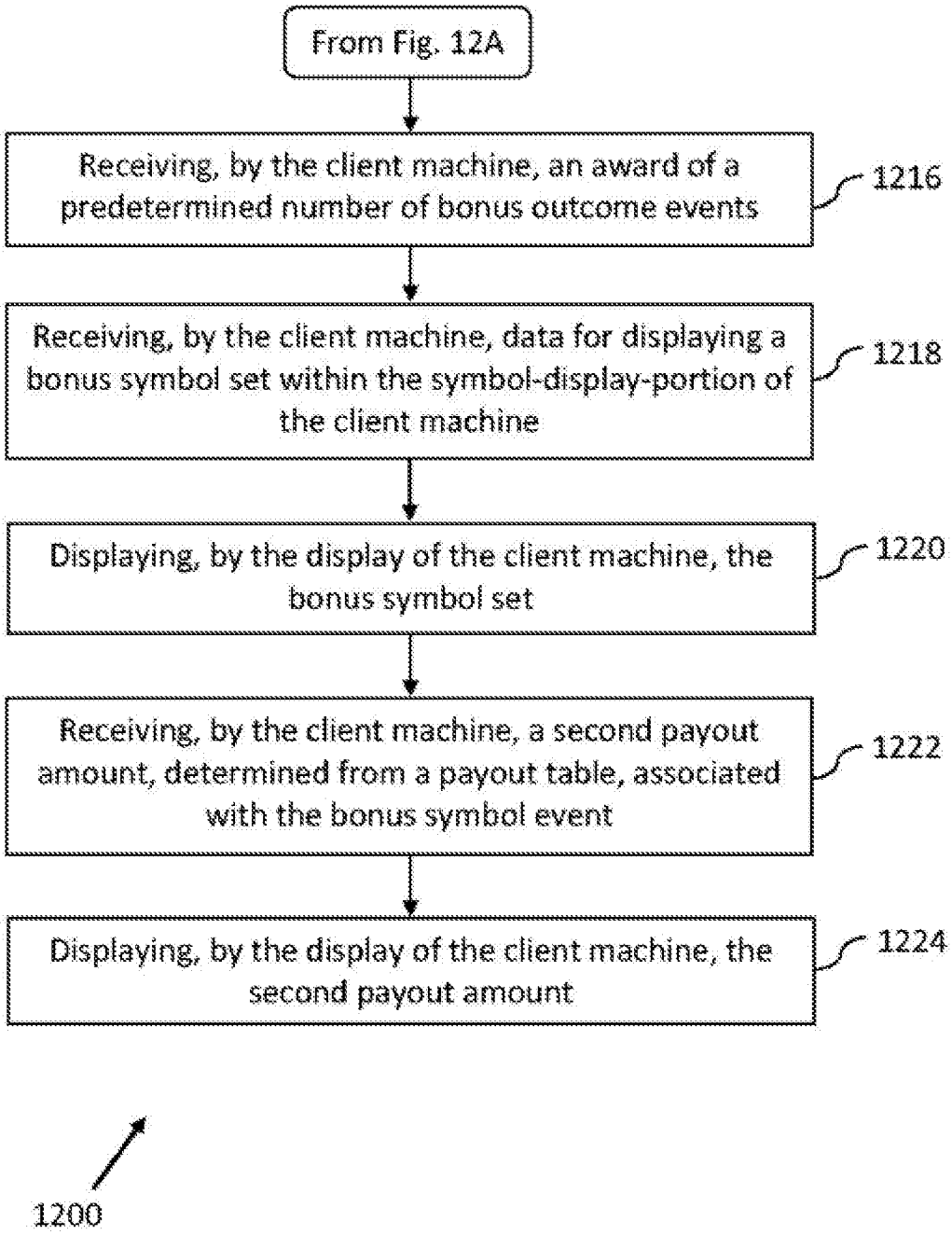
FIG. 12B is a second part of the flow chart of FIG. 12A, in accordance with example embodiments.

FIGS. 12A-12B depict a flowchart showing a set of operations 1200 (or more simply, "the set 1200") that can, for example, be carried out using client machine 100*b*. Note that several of the operations described in connection with FIGS. 12A-12B parallel operations described in connection with FIGS. 3A-3C and FIGS. 11A-11C. As such, variations of the operations described in connection with FIGS. 3A-3C and FIGS. 11A-11C are likewise applicable to the operations described in connection with FIGS. 12A-12B. However, for the sake of brevity, these variations are not repeated. The client machine 100*b*, in performing the set 1200, can perform the operations described above with respect to machine 100.

Turning to FIG. 12A, block 1202 includes receiving, by the client machine 100*b*, a wager via the user interface 104*b*. Client machine 100*b* can transmit the received wager or data indicative thereof over the communication network 116 to server machine 100*a*.

Next, block 1204 includes receiving, by the client machine 100*b*, a play request via the user interface 104*b*. Client machine 100*b* can transmit the received play request or data indicative thereof over the communication network 116 to server machine 100*a*.

Next, block 1206 includes receiving, by the client machine 100*b*, data for displaying a first symbol set within the symbol-display-portion of the display 110*b* for a first base outcome event.

Next, block 1208 includes displaying, by the display 100*b* of the client machine 100*b*, the first symbol set.

Next, block 1210 includes receiving, by the client machine 100*b*, a first payout amount, determined from a payout table, associated with the first symbol set.

Next, block 1212 includes displaying, by the display 110*b* of the client machine 100*b*, the determined first payout amount.

Next, block 1214 includes displaying, by the display 110*b* of the client machine 100*b*, occurrence of a trigger event during the base outcome event.

Turning to FIG. 12B, block 1216 includes receiving, by the client machine 100*b*, an award of a predetermined number of consecutive bonus outcome events.

Next, block 1218 includes receiving, by the client machine 100*b*, data for displaying a bonus symbol set within a symbol-display-portion, in which the bonus symbol set is either a first-category bonus symbol set that excludes any instance of a predetermined symbol, or a second-category bonus symbol set that includes at least one instance of the predetermined symbol.

Next, block 1220 includes displaying, by the display 100*b* of the client machine 100*b*, the bonus symbol set.

Next, block 1222 includes receiving, by the client machine 100*b*, a second payout amount, determined from a payout table, associated with the bonus symbol set.

Next, block 1224 includes displaying, by the display 110*b* of the client machine 100*b*, the determined second payout amount.

Figure 13:
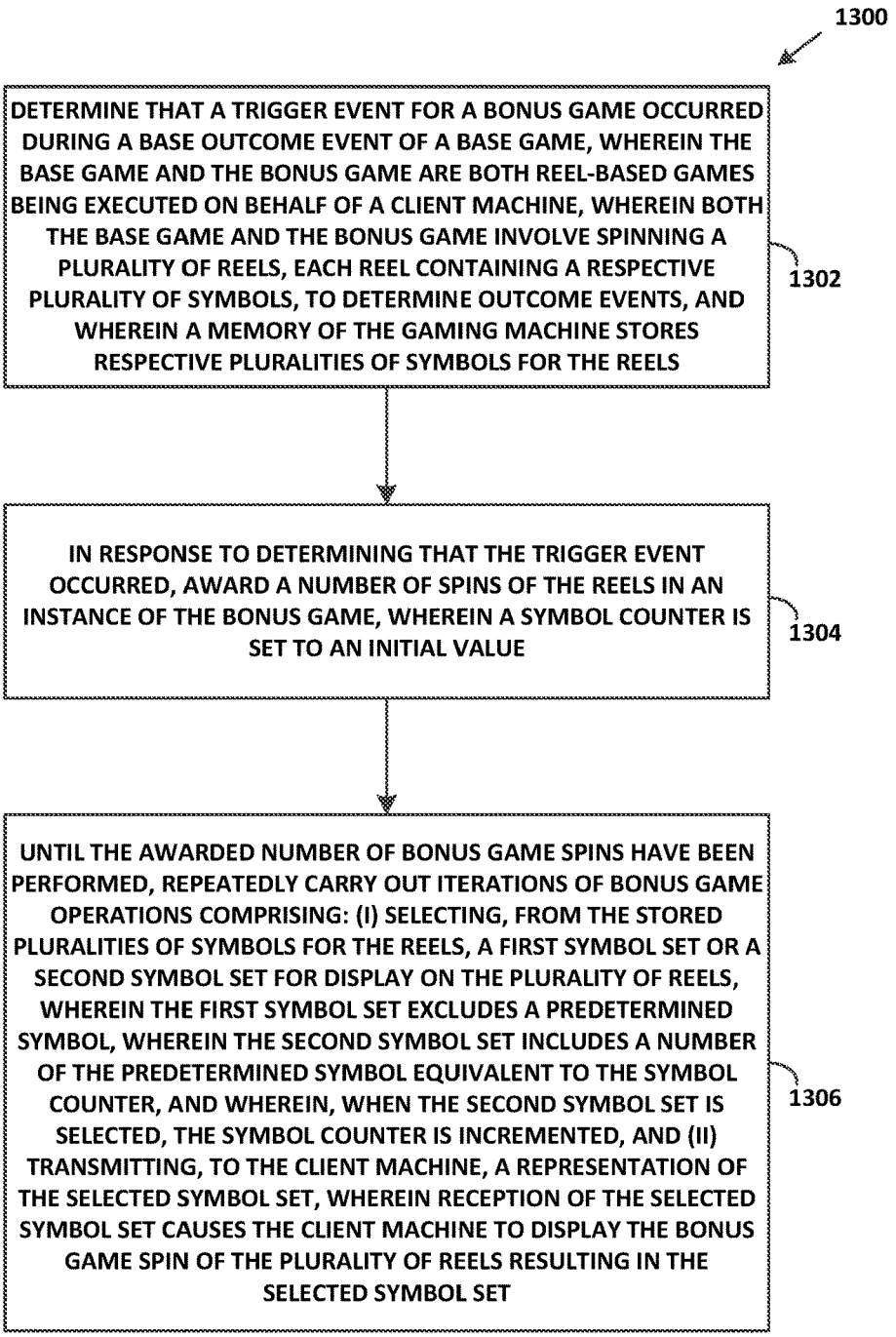
FIG. 13 is a flow chart, in accordance with example embodiments.

FIG. 13 depicts a flowchart showing a set of operations 1300 (or more simply, "the set 1300") that can, for example, be carried out using server machine 100*a* and/or client machine 100*b*. To the extent that a client machine carries out any of the set 1300, these operations may also include displaying various types of information, such as symbol sets, payout amounts, and so on. Note that several of the operations described in connection with FIG. 13 parallel operations described in connection with FIGS. 3A-3C, FIGS. 11A-11C, and FIGS. 12A-12B. As such, variations of the operations described in connection with FIGS. 3A-3C, FIGS. 11A-11C, and FIGS. 12A-12B are likewise applicable to the operations described in connection with FIG. 13.

Block 1302 may involve determining that a trigger event for a bonus game occurred during a base outcome event of a base game. The base game and the bonus game may both be reel-based games being executed on behalf of a client machine. Both the base game and the bonus game may involve spinning a plurality of reels, each reel containing a respective plurality of symbols, to determine outcome events. A memory may store respective pluralities of symbols for the reels.

Block 1304 may involve, possibly in response to determining that the trigger event occurred, awarding a number of spins of the reels in an instance of the bonus game. A symbol counter may be set to an initial value.

Block 1306 may involve, until the awarded number of bonus game spins have been performed, repeatedly carrying out iterations of bonus game operations. These operations may include: (i) selecting, from the stored pluralities of symbols for the reels, a first symbol set or a second symbol set for display on the plurality of reels, where the first symbol set excludes a predetermined symbol, where the second symbol set includes a number of the predetermined symbol equivalent to the symbol counter, and where, when the second symbol set is selected, the symbol counter is incremented, and (ii) transmitting, to the client machine, a representation of the selected symbol set, where reception of the selected symbol set causes the client machine to display the bonus game spin of the plurality of reels resulting in the selected symbol set. The predetermined symbol may be a Wild symbol.

In some embodiments, each reel includes a respective cyclical sequence of symbols. Selecting the symbol set for display on the plurality of reels may involve, for each reel, randomly selecting a respective reel position that displays a subsequence of the symbols on the reel that are in the selected symbol set. Alternatively or additionally, selecting the symbol set for display on the plurality of reels may involve simulating a spin of all reels.

In some embodiments, the initial value of the symbol counter is at least 1. For instance, this initial value may be any of 1, 2, 3, or some other value. In other embodiments, the initial value may be 0. Incrementing the symbol counter may involve adding at least 1 to the symbol counter. For example, 1, 2, 3, or some other value may be added to the symbol counter.

In some embodiments, both the base game and the bonus game have five reels and each of the five reels displays three symbols at a time.

In some embodiments, the second symbol set is the selected symbol set, and the client machine displaying the bonus game spin involves displaying an animation of the plurality of reels spinning for a particular iteration of the bonus game, and before all of the plurality of reels finish spinning in the animation, indicating, on the client machine, selected positions for each of the predetermined symbols.

In some embodiments, iterations of the bonus game operations may further involve determining a bonus payout amount associated with the selected symbol set, and transmitting, to the client machine, an indication of the bonus payout amount. When the second symbol set is the selected symbol set, the bonus payout amount may be based on predetermined symbols displayed on the plurality of reels. Alternatively or additionally, the client machine may be associated with a credit account, and the credit account may be debited to play the base game, credited in response to the trigger event, and credited by the bonus payout amount.

In some embodiments, the gaming machine may simultaneously execute reel-based games in real time on behalf of at least 30 client machines, where each of the at least 30 client machines communicates with the one or more processors by way of a wide-area packet-switched network. In some cases, the one or more processors may simultaneously execute reel-based games in real time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

The client machine may include the one or more processors and the memory.

In a further embodiment that may be a variation of that of FIG. 13, a gaming machine may be configured for a reel-based game, where the reel-based game is executed on behalf of a client machine, and where the reel-based game involves spinning a plurality of reels to determine outcome events.

The gaming system may include a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account.

The gaming system may further include one or more gaming device processors, and one or more gaming device memory devices storing respective pluralities of symbols for the reels and a plurality of gaming device instructions. The gaming device instructions may be executable by the one or more gaming device processors to perform operations.

The operations may involve determining that a trigger event for a bonus game occurred during a base outcome event of a base game, where the base game and the bonus game are both part of the reel-based game; in response to determining that the trigger event occurred, awarding a number of spins of the reels in an instance of the bonus game, where a symbol counter is set to an initial value; and until the awarded number of bonus game spins have been performed, repeatedly carrying out iterations of bonus game operations involving: (i) selecting, from the stored pluralities of symbols for the reels, a first symbol set or a second symbol set for display on the plurality of reels, where the first symbol set excludes a predetermined symbol, where the second symbol set includes a number of the predetermined symbol equivalent to the symbol counter, and where, when the second symbol set is selected, the symbol counter is incremented, and (ii) transmitting, to the client machine, a representation of the selected symbol set, where reception of the selected symbol set causes the client machine to display the bonus game spin of the plurality of reels resulting in the selected symbol set.

Additionally, any feature discussed in the context of FIGS. 1-13 may also be combined with this embodiment.

Figure 14:
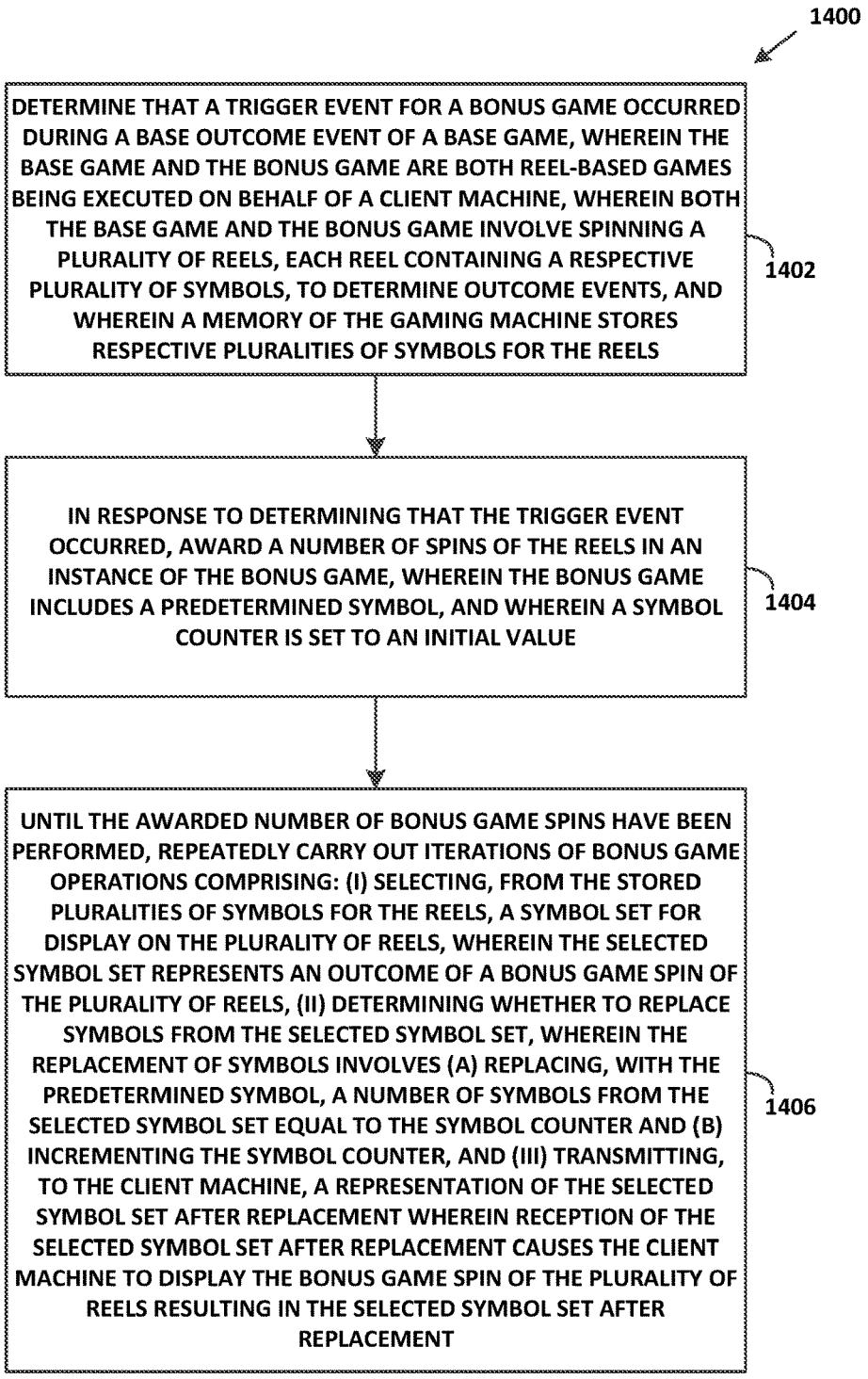
FIG. 14 is a flow chart, in accordance with example embodiments.

FIG. 14 depicts a flowchart showing a set of operations 1400 (or more simply, "the set 1400") that can, for example, be carried out using server machine 100*a* and/or client machine 100*b*. To the extent that a client machine carries out any of the set 1400, these operations may also include displaying various types of information, such as symbol sets, payout amounts, and so on. Note that several of the operations described in connection with FIG. 14 may parallel operations described in connection with FIGS. 3A-3C, FIGS. 11A-11C, FIGS. 12A-12B, and FIG. 13. As such, variations of the operations described in connection with FIGS. 3A-3C, FIGS. 11A-11C, FIGS. 12A-12B, and FIG. 13 are likewise applicable to the operations described in connection with FIG. 14.

Block 1402 may involve a gaming machine determining that a trigger event for a bonus game occurred during a base outcome event of a base game. The base game and the bonus game may both be reel-based games executed on behalf of a client machine. Further, both the base game and the bonus game may involve spinning a plurality of reels, each reel containing a respective plurality of symbols, to determine outcome events. A memory of the gaming machine may store respective pluralities of symbols for the reels.

Block 1404 may involve, possibly in response to determining that the trigger event occurred, awarding a number of spins of the reels in an instance of the bonus game. The bonus game may include a predetermined symbol. The predetermined symbol may be a Wild symbol. Additionally, a symbol counter may be set to an initial value.

Block 1406 may involve, until the awarded number of bonus game spins have been performed, repeatedly carrying out iterations of bonus game operations. These operations may include: (i) selecting, from the stored pluralities of symbols for the reels, a symbol set for display on the plurality of reels, where the selected symbol set represents an outcome of a bonus game spin of the plurality of reels, (ii) determining whether to replace symbols from the selected symbol set, where the replacement of symbols involves (a) replacing, with the predetermined symbol, a number of symbols from the selected symbol set equal to the symbol counter and (b) incrementing the symbol counter, and (iii) transmitting, to the client machine, a representation of the selected symbol set after replacement, where reception of the selected symbol set after replacement causes the client machine to display the bonus game spin of the plurality of reels resulting in the selected symbol set after replacement.

In some embodiments, in the bonus game, the stored pluralities of symbols for the reels do not include the predetermined symbol. Nonetheless, in some cases, the stored pluralities of symbols for the reels may include one or more predetermined symbols. In other words, the selected symbol set may be drawn from symbols that exclude or include the predetermined symbol.

In some embodiments, each reel may include a respective cyclical sequence of symbols, and selecting the symbol set for display on the plurality of reels may involve, for each reel, randomly selecting a respective reel position that displays a subsequence of the symbols on the reel that are in the selected symbol set. Alternatively or additionally, selecting the symbol set for display on the plurality of reels may involve simulating a spin of all reels. As just one possible example, both the base game and the bonus game may have five reels and each of the five reels may display three symbols at a time.

In some embodiments, the initial value of the symbol counter is at least 1. For instance, this initial value may be any of 1, 2, 3, or some other value. In other embodiments, the initial value may be 0. Incrementing the symbol counter may involve adding at least 1 to the symbol counter. For example, 1, 2, 3, or some other value may be added to the symbol counter.

In some embodiments, causing the client machine to display the selected symbol set after replacement involves causing the client machine to display an animated avatar interacting with the reels to replace symbols. Alternatively or additionally, the client machine displaying the selected symbol set after replacement may involve displaying an animation of the plurality of reels spinning for a particular iteration of the bonus game. Before all of the plurality of reels finish spinning in the animation, the client machine may indicate selected positions for each of the symbols to be replaced.

Figure 15:
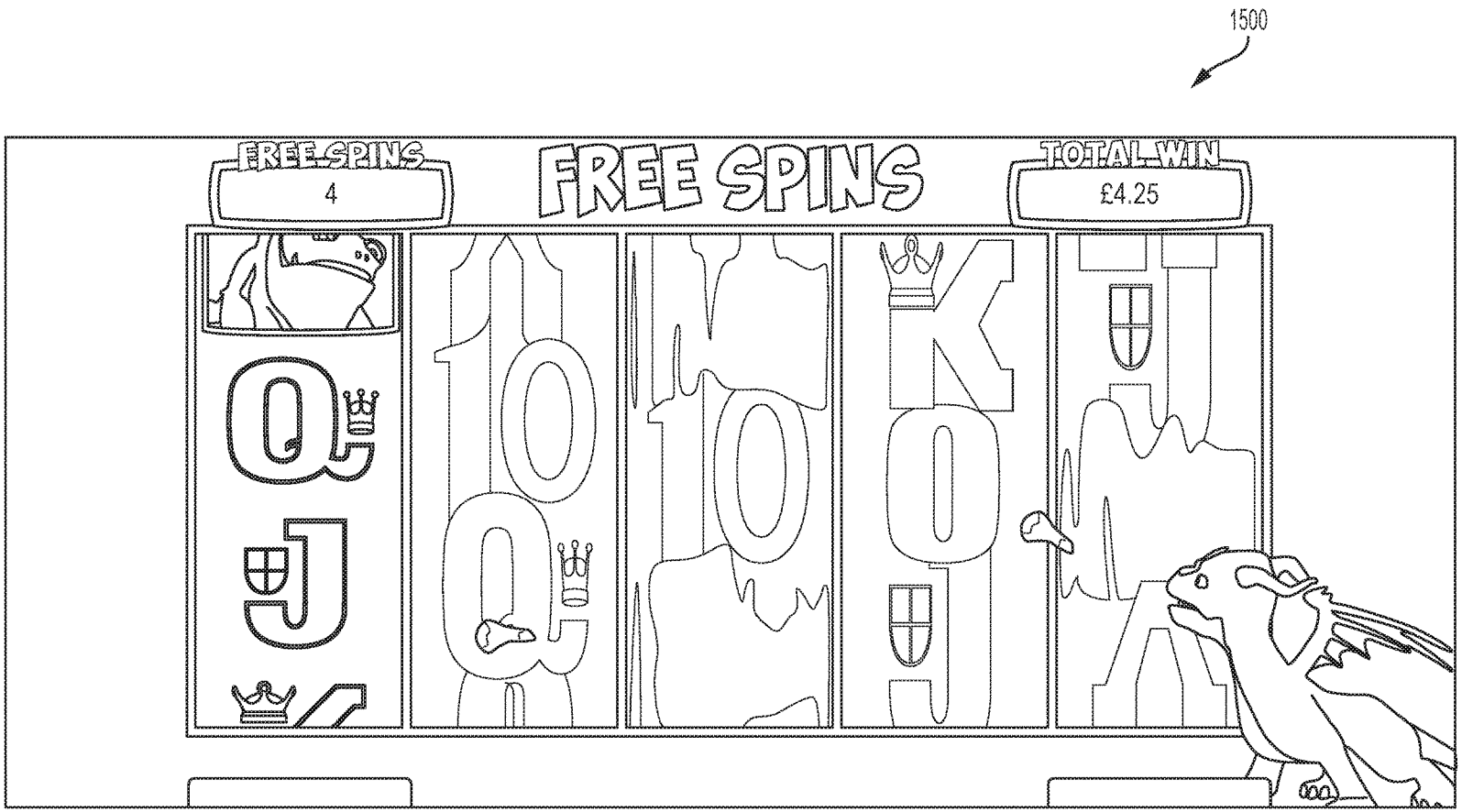
FIG. 15 depicts elements displayable by a display of a machine, in accordance with example embodiments.
Figure 16:
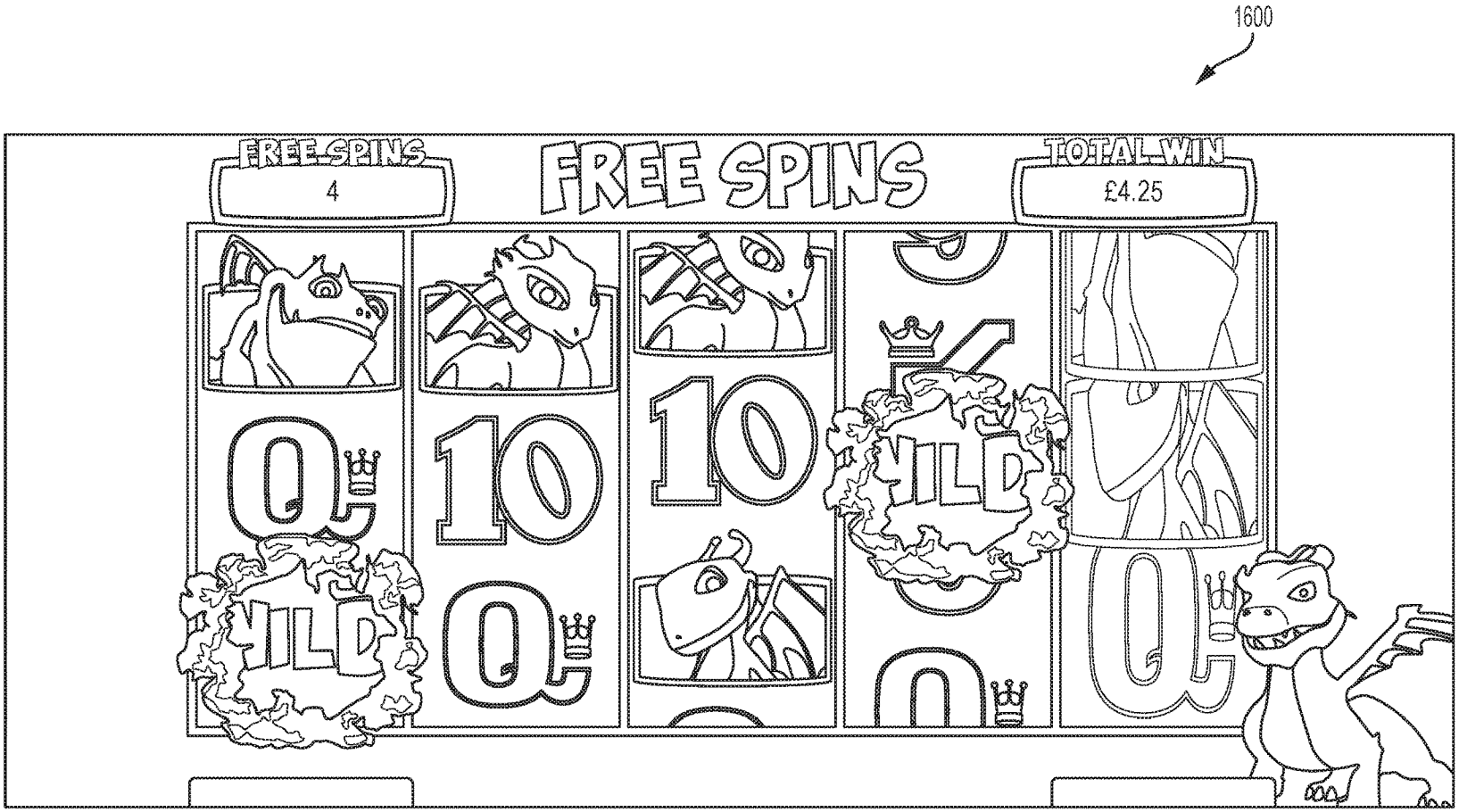
FIG. 16 depicts elements displayable by a display of a machine, in accordance with example embodiments.

FIGS. 15 and 16 provide an example of such animation. In FIG. 15, display 1500 depicts a dragon avatar spitting balls of fire at two arrangement positions on a five-column, three-row matrix of symbols, while the four of the reels are spinning. In FIG. 16, the balls of fire land at arrangement positions C1,R3 and C4,R2, causing the symbols at these arrangement positions to be replaced with predetermined (Wild) symbols. In FIG. 16, one of the reels is still spinning. The actions depicted in FIGS. 15 and 16 may take place when more or fewer reels are spinning.

In accordance with such an animation, there are at least two ways in which the selection of arrangement positions can be made. One way is for the arrangement positions to be selected after the symbols for those respective arrangement positions are determined. Then, these symbols are replaced with the predetermined symbol. Another way is for the arrangement positions to be selected before the symbols for those respective arrangement positions are determined. In this case, the "replacement" may be a replacement of arbitrary non-predetermined symbols (that would have otherwise populated the arrangement positions) with predetermined symbols. Other variations are possible.

Turning back to FIG. 14, iterations of the bonus game operations may further involve determining a bonus payout amount associated with the selected symbol set after replacement, and transmitting, to the client machine, an indication of the bonus payout amount. The bonus payout amount may be based on predetermined symbols displayed on the plurality of reels. Additionally, the client machine may be associated with a credit account, and the credit account may be debited to play the base game, credited in response to the trigger event, and credited by the bonus payout amount.

The gaming machine may simultaneously execute base games and/or bonus games in real time on behalf of at least 30 client machines. Each of the at least 30 client machines may communicate with the gaming machine by way of a wide-area packet-switched network. As noted above, simultaneous execution of such a large number of reel-based games in real time necessitates computer implementation.

In a further embodiment that may be a variation of that of FIG. 14, a gaming system may be configured for symbol replacement in a reel-based game. The reel-based game may be executed on behalf of a client machine, and the reel-based game may involve spinning a plurality of reels to determine outcome events.

The gaming system may include a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account.

The gaming system may also include one or more gaming device processors, and one or more gaming device memory devices storing respective pluralities of symbols for the reels and a plurality of gaming device instructions. The gaming device instructions may be executable by the one or more gaming device processors to perform operations.

These operations may involve determining that a trigger event for a bonus game occurred during a base outcome event of a base game, where the base game and the bonus game are both part of the reel-based game; possibly in response to determining that the trigger event occurred, awarding a number of spins of the reels in an instance of the bonus game, where the bonus game includes a predetermined symbol, and where a symbol counter is set to an initial value; and until the awarded number of bonus game spins have been performed, repeatedly carrying out iterations of bonus game operations involving: (i) selecting, from the stored pluralities of symbols for the reels, a symbol set for display on the plurality of reels, where the selected symbol set represents an outcome of a bonus game spin of the plurality of reels, (ii) determining whether to replace symbols from the selected symbol set, where the replacement of symbols involves (a) replacing, with the predetermined symbol, a number of symbols from the selected symbol set equal to the symbol counter and (b) incrementing the symbol counter, and (iii) transmitting, to the client machine, a representation of the selected symbol set after replacement, where reception of the selected symbol set after replacement causes the client machine to display the bonus game spin of the plurality of reels resulting in the selected symbol set after replacement.

Additionally, any feature discussed in the context of FIGS. 1-14 may also be combined with this embodiment.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method comprising:

determining, by one or more processors of a gaming machine, that a trigger event for a bonus game occurred during a base outcome event of a base game, wherein the base game and the bonus game are both reel-based games being executed on behalf of a client machine, wherein both the base game and the bonus game involve spinning a plurality of reels, each reel containing a respective plurality of symbols, to determine outcome events, and wherein a memory of the gaming machine stores respective pluralities of symbols for the reels;

in response to determining that the trigger event occurred, awarding, by the one or more processors, a number of spins of the reels in an instance of the bonus game, wherein a symbol counter is set to an initial value; and until the awarded number of bonus game spins have been performed, the one or more processors repeatedly carrying out iterations of bonus game operations comprising:

selecting, from the stored pluralities of symbols for the reels, a symbol set for display on the plurality of reels, wherein the selected symbol set includes a number of a predetermined symbol equivalent to the symbol counter;

incrementing the symbol counter; and transmitting, to the client machine, a representation of the selected symbol set, wherein reception of the selected symbol set causes the client machine to display the bonus game spin of the plurality of reels resulting in the selected symbol set, wherein displaying the bonus game spin comprises: displaying an animation of the plurality of reels spinning for a particular iteration of the bonus game, and before all of the plurality of reels finish spinning in the animation, indicating, on the client machine, selected positions for each of the predetermined symbols.

2. The method of claim 1, wherein the predetermined symbol is a Wild symbol.

3. The method of claim 1, wherein each reel comprises a respective cyclical sequence of symbols, and wherein selecting the symbol set for display on the plurality of reels comprises:

for each reel, randomly selecting a respective reel position that displays a subsequence of the symbols on the reel that are in the selected symbol set.

4. The method of claim 1, wherein selecting the symbol set for display on the plurality of reels comprises simulating a spin of all reels.

5. The method of claim 1, wherein the initial value of the symbol counter is at least 1.

6. The method of claim 1, wherein incrementing the symbol counter comprises adding at least 1 to the symbol counter.

7. The method of claim 1, wherein both the base game and the bonus game have five reels and each of the five reels displays three symbols at a time.

8. The method of claim 1, wherein iterations of the bonus game operations further comprise:

determining a bonus payout amount associated with the selected symbol set; and transmitting, to the client machine, an indication of the bonus payout amount.

9. The method of claim 8, wherein the bonus payout amount is based on predetermined symbols displayed on the plurality of reels.

10. The method of claim 8, wherein the client machine is associated with a credit account, and wherein the credit account is debited to play the base game, credited in response to the trigger event, and credited by the bonus payout amount.

11. The method of claim 1, wherein the gaming machine simultaneously executes base games or bonus games in real time on behalf of at least 30 client machines, and wherein each of the at least 30 client machines communicates with the gaming machine by way of a wide-area packet-switched network.

12. A gaming system configured for a reel-based game, wherein the reel-based game is executed on behalf of a client machine, wherein the reel-based game involves spinning a plurality of reels to determine outcome events, the gaming system comprising:

a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more gaming device processors; and one or more gaming device memory devices storing respective pluralities of symbols for the reels and a plurality of gaming device instructions, the gaming device instructions executable by the one or more gaming device processors to perform operations comprising:

determining that a trigger event for a bonus game occurred during a base outcome event of a base game, wherein the base game and the bonus game are both part of the reel-based game;

in response to determining that the trigger event occurred, awarding a number of spins of the reels in an instance of the bonus game, wherein a symbol counter is set to an initial value; and until the awarded number of bonus game spins have been performed, repeatedly carrying out iterations of bonus game operations comprising:

selecting, from the stored pluralities of symbols for the reels, a first symbol set or a second symbol set for display on the plurality of reels, wherein the first symbol set excludes a predetermined symbol, wherein the second symbol set includes a number of the predetermined symbol equivalent to the symbol counter, and wherein, when the second symbol set is selected, the symbol counter is incremented, and transmitting, to the client machine, a representation of the selected symbol set, wherein reception of the selected symbol set causes the client machine to display the bonus game spin of the plurality of reels resulting in the selected symbol set, wherein when the second symbol set is the selected symbol set displaying the bonus game spin comprises: displaying an animation of the plurality of reels spinning for a particular iteration of the bonus game, and before all of the plurality of reels finish spinning in the animation, indicating, on the client machine, selected positions for each of the predetermined symbols.

13. A computer-implemented method comprising:

determining, by one or more processors of a gaming machine, that a trigger event for a bonus game occurred during a base outcome event of a base game, wherein the base game and the bonus game are both reel-based games being executed on behalf of a client machine, wherein both the base game and the bonus game involve spinning a plurality of reels, each reel containing a respective plurality of symbols, to determine outcome events, and wherein a memory of the gaming machine stores respective pluralities of symbols for the reels;

in response to determining that the trigger event occurred, awarding, by the one or more processors, a number of spins of the reels in an instance of the bonus game, wherein the bonus game includes a predetermined symbol, and wherein a symbol counter is set to an initial value; and until the awarded number of bonus game spins have been performed, the one or more processors repeatedly carrying out iterations of bonus game operations comprising:

selecting, from the stored pluralities of symbols for the reels, a symbol set for display on the plurality of reels, wherein the selected symbol set represents an outcome of a bonus game spin of the plurality of reels, determining whether to replace symbols from the selected symbol set, wherein the replacement of symbols involves (i) replacing, with the predetermined symbol, a number of symbols from the selected symbol set equal to the symbol counter and (ii) incrementing the symbol counter, and transmitting, to the client machine, a representation of the selected symbol set after replacement, wherein reception of the selected symbol set after replacement causes the client machine to display the bonus game spin of the plurality of reels resulting in the selected symbol set, wherein displaying the bonus game spin comprises: displaying an animation of the plurality of reels spinning for a particular iteration of the bonus game, and before all of the plurality of reels finish spinning in the animation, indicating, on the client machine, selected positions for each of the predetermined symbols.

14. The method of claim 13, wherein, in the bonus game, the stored pluralities of symbols for the reels do not include the predetermined symbol.

15. The method of claim 13, wherein each reel comprises a respective cyclical sequence of symbols, and wherein selecting the symbol set for display on the plurality of reels comprises:

for each reel, randomly selecting a respective reel position that displays a subsequence of the symbols on the reel that are in the selected symbol set.

16. The method of claim 13, wherein iterations of the bonus game operations further comprise:

determining a bonus payout amount associated with the selected symbol set after replacement; and transmitting, to the client machine, an indication of the bonus payout amount.

17. The method of claim 16, wherein the bonus payout amount is based on predetermined symbols displayed on the plurality of reels.

18. The method of claim 16, wherein the client machine is associated with a credit account, and wherein the credit account is debited to play the base game, credited in response to the trigger event, and credited by the bonus payout amount.

* * * * *